US007322076B2

(12) United States Patent
Ninomiya

(10) Patent No.: US 7,322,076 B2
(45) **Date of Patent: *Jan. 29, 2008**

(54) CLASP FOR JEWELRY

(75) Inventor: Tomoyasu Ninomiya, Tokyo (JP)

(73) Assignee: Seberu Pico Co., Ltd., Tokyo (JP)

( * ) Notice: Subject to any disclaimer, the term of this patent is extended or adjusted under 35 U.S.C. 154(b) by 21 days.

This patent is subject to a terminal disclaimer.

(21) Appl. No.: 11/065,520

(22) Filed: Feb. 25, 2005

(65) Prior Publication Data

US 2005/0188512 A1 Sep. 1, 2005

(30) Foreign Application Priority Data

Feb. 27, 2004 (JP) ..... 2004-053839
Jan. 24, 2005 (JP) ..... 2005-016023

(51) Int. Cl.
*A44B 11/26* (2006.01)
*A44C 25/00* (2006.01)
*A44B 11/25* (2006.01)

(52) U.S. Cl. ..... 24/587.11; 24/658

(58) Field of Classification Search ..... 24/587.1, 24/587.11, 574.1, 594.1, 594.11, 658, 653, 24/633, 640, 706.8, 707.9, 707.6, 614; 63/3, 63/3.11, 4, 38
See application file for complete search history.

(56) References Cited

U.S. PATENT DOCUMENTS 818,530 A * 4/1906 Fischer ..... 24/706.8
1,093,689 A * 4/1914 Broussard ..... 68/137
1,348,666 A * 8/1920 Schuler ..... 24/706.8
1,472,681 A * 10/1923 Roy ..... 24/706.8
1,492,853 A * 5/1924 Johnson ..... 24/706.8
1,525,953 A * 2/1925 Richards ..... 24/706.8
2,629,156 A * 2/1953 Kamens et al. ..... 24/657
2,725,610 A * 12/1955 Smith ..... 24/656
3,765,064 A * 10/1973 Hoober et al. ..... 24/658
4,398,323 A * 8/1983 Beard ..... 24/633
4,401,388 A * 8/1983 Mearns ..... 63/3
4,425,687 A * 1/1984 Sauer ..... 24/664
4,924,562 A * 5/1990 Pogharian ..... 24/647
6,145,171 A * 11/2000 Hoshino ..... 24/587.1
6,484,376 B1 * 11/2002 Khatchadourian et al. .... 24/658
6,508,080 B1 * 1/2003 Ninomiya ..... 63/3.1
7,082,651 B2 * 8/2006 Ninomiya ..... 24/658

FOREIGN PATENT DOCUMENTS

JP 8-89320 4/1996

* cited by examiner

*Primary Examiner*—Robert J. Sandy
(74) *Attorney, Agent, or Firm*—McGinn IP Law Group, PLLC

(57) ABSTRACT

The clasp for jewelry includes a body, a pin insertable into the body, a stopper engaging to the pin having been inserted into the body to keep the pin engaged to the body, and a releaser releasing the pin from the body. When pulled or slid, the releaser releases the pin from the body.

15 Claims, 27 Drawing Sheets

CLASP FOR JEWELRY

BACKGROUND OF THE INVENTION

1. Field of the Invention

The invention relates to a clasp used for jewelry.

2. Description of the Related Art

The clasp suggested in Japanese Patent Application Publication No. 8-89320 is comprised of a body having a connection ring, a pin to be inserted into the body, a stopper engaged to the pin to thereby prevent the pin from releasing from the body, and a releaser for ceasing engagement of the stopper with the pin.

The releaser and the stopper are formed integrally with each other. The releaser and the stopper are inserted into a hole formed with the body such that the releaser and the stopper are energized by a spring having been inserted into the hole. Then, the hole is sealed at its opening end to prevent the releaser, the stopper and the spring from dropping out of the hole.

The releaser projects beyond the body. The body is formed a through-hole extending perpendicularly to the above-mentioned hole so as to intersect with the hole in the body.

The pin is formed with grooves to which the stopper is to be engaged.

Inserting the pin into the through-hole, the stopper is engaged to one of the grooves at an intersection of the hole and the through-hole. Since the stopper is compressed by the spring, the pin is prevented from releasing from the body.

The releaser is pushed into the body against the spring to thereby release the stopper from the pin, and thus, a user can draw the pin out of the body.

The releaser is formed small in the above-mentioned conventional clasp. Hence, since the stopper is released from the pin by pushing the releaser, a user might have a pain in his/her finger, if he/she frequently pushes the releaser.

In an accessory such as a clasp, not only decoration thereof, but also novelty and/or uniqueness in a function thereof draw attention of a user. However, since conventional clasps are all designed to push a releaser for releasing a stopper from a pin, the conventional clasps fail to draw attention of a user with respect to a function.

SUMMARY OF THE INVENTION

In view of the above-mentioned problems in the conventional clasps, it is an object of the present invention to provide a clasp which is capable of preventing a user from having a pain in his/her finger, even if a releaser is formed small, and further, drawing attention of a user with respect to a function.

Hereinbelow is described the clasp in accordance with the present invention through the use of reference numerals used in later described embodiments. The reference numerals are indicated only for the purpose of clearly showing correspondence between claims and the embodiments. It should be noted that the reference numerals are not allowed to interpret of claims of the present application.

There is provided a clasp for jewelry, including a body (10), a pin (20) insertable into the body (10), a stopper (31) engaging to the pin (20) having been inserted into the body (10) to keep the pin (20) engaged to the body (10), and a releaser (32) releasing the pin (20) from the body (10), wherein when pulled, the releaser (32) releases the pin (20) from the body (10).

It is preferable that the pin (20) is formed with a groove (21) through which the stopper (31) is engaged to the pin (20).

It is preferable that the pin (20) is formed with a plurality of grooves (21) through each of which the stopper (31) is engaged to the pin (20), the grooves (21) being arranged longitudinally of the pin (20).

The clasp may further include a cylinder (30) to which the stopper (31) and the releaser (32) are integrally formed, the cylinder (30) being movable relative to the body (10).

The clasp may further include a second stopper (50) for preventing the cylinder (30) from releasing from the body (10).

It is preferable that the second stopper (50) is disposed in the body (10).

It is preferable that the second stopper (50) passes through the cylinder (30), with the cylinder (30) being inserted into the body (10), in a direction intersecting with a direction in which the cylinder (30) is inserted into the body (10), and the second stopper (50) is supported at its opposite ends by the body (10) to prevent the second stopper (50) and the cylinder (30) from releasing from the body (10).

It is preferable that the second stopper (50) includes a spring (53) therein, and at least one end of the second stopper (50) is slidable against the spring (53), and wherein the second stopper (50) and the cylinder (30) can be released from the body (10) by sliding the one end of the second stopper (50).

It is preferable that the second stopper (50) is comprised of a pin (50).

The clasp may further include a coil spring (40) energizing the cylinder (30) in a direction in which the stopper (31) engages to the pin (20), the coil spring (40) being arranged around the cylinder (30).

It is preferable that the coil spring (40) receives reaction force from an inner surface of the body (10) to thereby energize the cylinder (30).

It is preferable that the cylinder (30) and the coil spring (40) are prevented from releasing from the by one coil spring (40).

It is preferable that the cylinder (30) has an end (37) disposed oppositely to the releaser (32), the end (37) cooperating with the body (10) to define an outer surface of the clasp.

It is preferable that at least one of the cylinder (30) and the body (10) is formed with a hole (38) through which a sound generated when the stopper (31) is engaged to the pin (20) is emitted out of the clasp.

The clasp may further include a connector (16, 26, 61) integrally formed with at least one of the pin (20), the body (10) and the releaser (32), and wherein a charm (60, 80) is connected to the at least one of the pin (20), the body (10) and the releaser (32) through the connector (16, 26, 61).

There is further provided a clasp for jewelry, including a body (810), a pin (870) insertable into the body (810), a stopper (836) engaging to the pin (870) having been inserted into the body (810) to keep the pin (870) engaged to the body (810), and a releaser (832) releasing the pin (870) from the body (810), wherein when slid, the releaser (832) releases the pin (870) from the body (810).

The clasp may further include a cylinder (830) to which the stopper (836) and the releaser (832) are integrally formed, the cylinder (830) being movable relative to the body (810).

The clasp may further include a case (860) detachably disposed in the body (810), the pin (870) being to be inserted into the case (860) disposed in the body (810).

The clasp may further include a connector (880) through which a charm (60, 80) is connected to the clasp and which is detachable relative to the body (810), and wherein the connector (880) is disposed in the case (860) to thereby prevent from releasing from the body (810).

The advantages obtained by the aforementioned present invention will be described hereinbelow.

In the clasp in accordance with the present invention, the stopper is released from the pin merely by pulling or sliding the releaser. Hence, even if the releaser is small in size, a user would not have a pain in his/her finger. In addition, since the stopper is released from the pin by making novel and unique operation, that is, pulling or sliding the releaser, it would be possible to draw attention of a user with respect to a function of a clasp.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

First Embodiment

Figure 1:
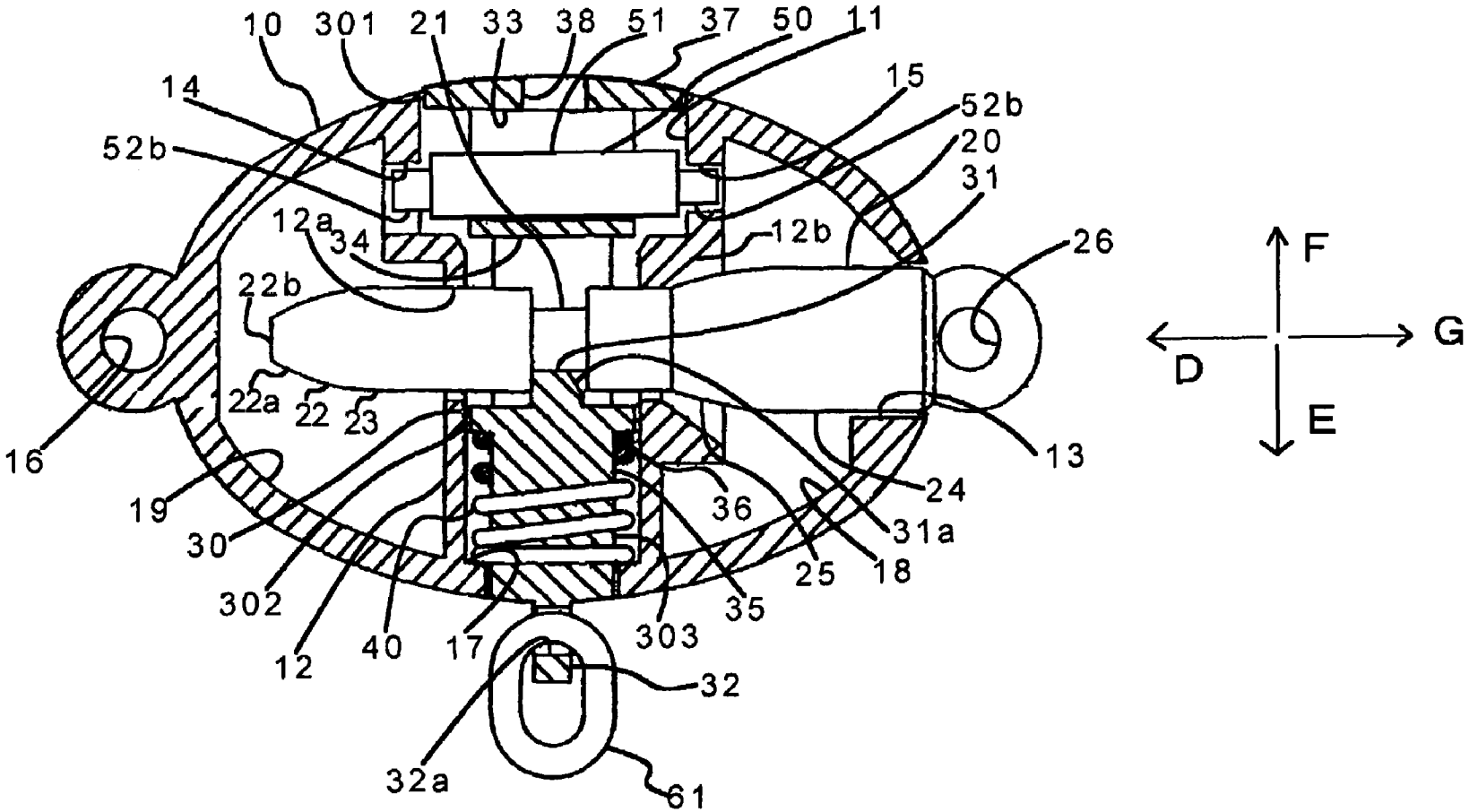
FIG. 1 is a cross-sectional view of the clasp in accordance with the first embodiment of the present invention.
Figure 2:
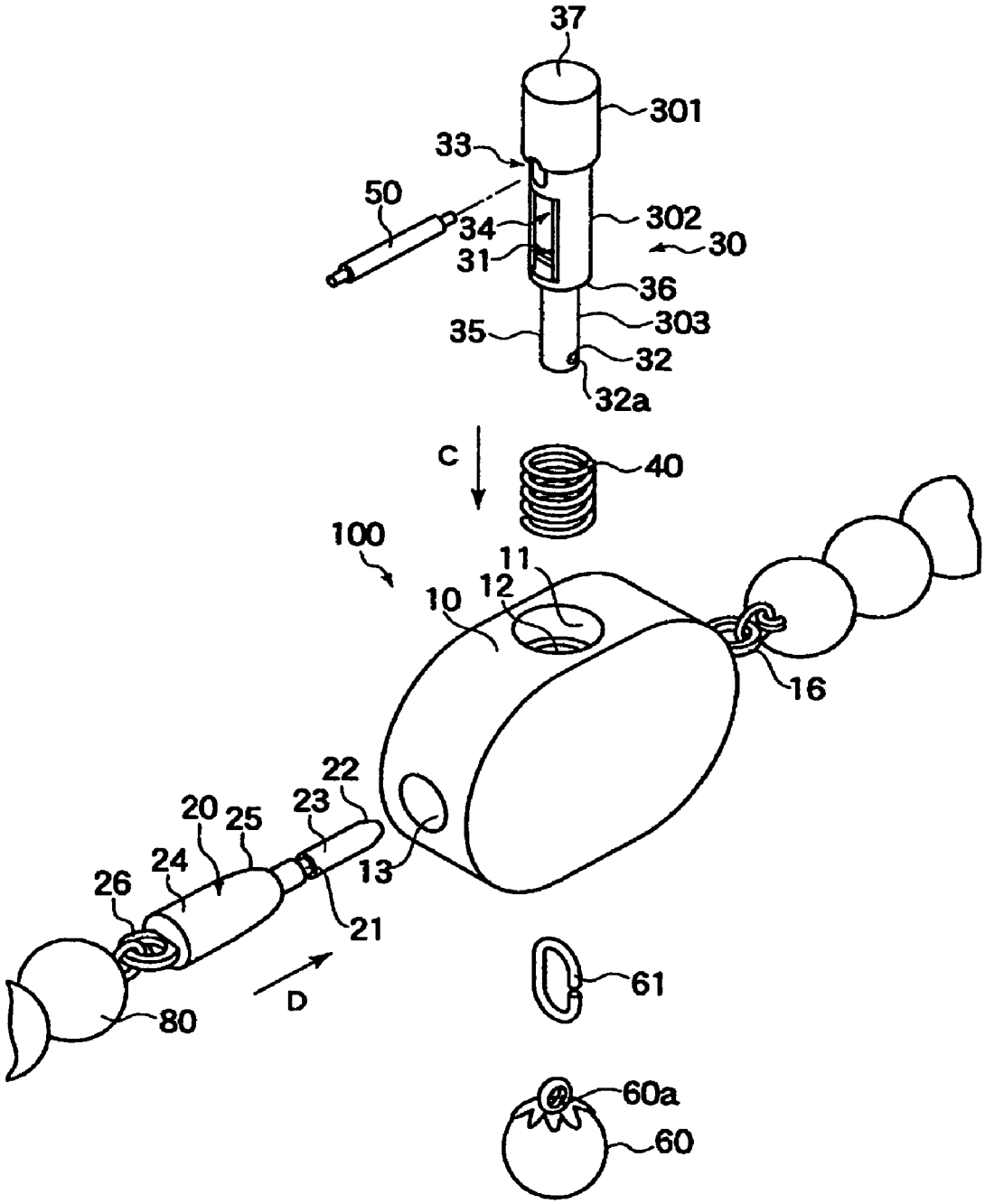
FIG. 2 is an exploded perspective view of the clasp in accordance with the first embodiment of the present invention.

FIG. 1 is a cross-sectional view of a clasp 100 in accordance with the first embodiment, and FIG. 2 is an exploded perspective view of the clasp 100. A horizontal positional relation in FIG. 2 is just opposite to FIG. 1.

As illustrated in FIGS. 1 and 2, the clasp 100 is comprised of a body 10, a pin 20 to be inserted into the body 10, a stopper 31 engaging to the pin 20 having been inserted into the body 10 to keep the pin 20 engaged to the body 10, and a releaser 32 which ceases engagement of the stopper 31 with the pin 20 to thereby release the pin 20 from the body 10.

The stopper 31 and the releaser 32 are formed integrally with each other. Specifically, the stopper 31 defines a part of a cylinder 30, and the releaser 32 also defines a part of the cylinder 30. The cylinder 30 is disposed in the body 10 so as to be movable relative to the body 10.

The clasp 100 further includes a coil spring 40 energizing the cylinder 30, and a pin 50 preventing the coil spring 40 and the cylinder 30 from dropping out of the body 10.

Figure 3:
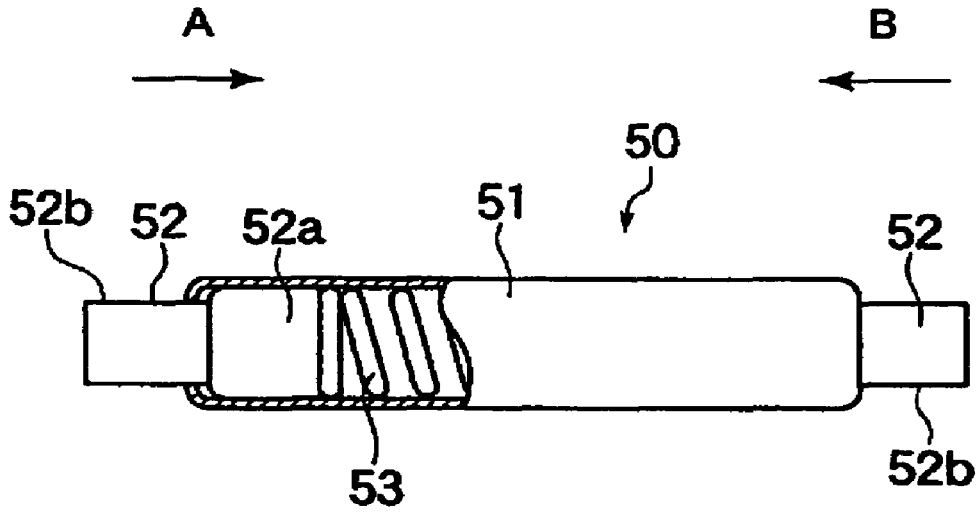
FIG. 3 is a front view, partially a cross-sectional view, of a pin used in the clasp in accordance with the first embodiment of the present invention.

FIG. 3 illustrates an example of a structure of the pin 50.

The pin 50 is comprised of a cylinder 51, a pair of bars 52 slidable in the cylinder 50 such that they can project through openings at opposite ends of the cylinder 51, and a coil spring 53 disposed in the cylinder 51 in compressed condition.

Each of the bars 52 is comprised of a first portion 52*a* slidable on an inner surface of the cylinder 51, and a second portion 52*b* having a diameter smaller than the same of the first portion 52*a*, and designed to project out of the cylinder 51 and extract into the cylinder 51.

The cylinder 51 is inwardly bent at opposite ends with the coil spring 53 and the bars 52 being disposed in the cylinder 51 such that openings at the opposite ends of the cylinder 51 have a diameter greater than the second portion 52*b*, but smaller than a diameter of the first portion 52*a*. Thus, the bars 52 and the coil spring 53 are prevented from dropping out of the cylinder 51.

Pushing the second portion 52*b* in a direction indicated with an arrow A or B, the first portion 52*a* slides along an inner surface of the cylinder 51, and the second portion 52*b* enters the cylinder against a force derived from the coil spring 53, as if the pin 50 extracts. Ceasing pushing the second portion 52*b*, the second portion 52*b* projects out of the cylinder 51 by virtue of a force derived from the coil spring 53, as if the pin 50 extends.

As illustrated in FIGS. 1 and 2, at least a portion of the pin 20, to be inserted into the body 10, is formed cylindrical. In the first embodiment, the pin 20 is entirely in the form of a cylinder.

The pin 20 is formed with a groove 21 to which the stopper 31 is engaged. For instance, the groove 21 is formed at a circumference of the pin 20.

As illustrated in FIG. 1, a distal end 22 of the pin 20 is comprised of a planar end 22*b*, and a tapered portion 22*a* having a diameter gradually decreasing towards the planar end 22*b*. The tapered portion 22*a* guides the pin 20 to a predetermined position, when the pin 20 is inserted into the body 10. The planar end 22*b* of the pin 20 prevents a user from being injured, unlike a sharpened end.

The pin 20 includes a smaller-diameter portion 23 and a greater-diameter portion 24. The groove 21 and the distal end 22 are formed in the smaller-diameter portion 23. The pin 20 is designed to include the greater-diameter portion 24 for a user to readily pinch the pin 20.

A boundary portion 25 formed between the smaller-diameter portion 23 and the greater-diameter portion 24 has a diameter varying from a diameter of the smaller-diameter portion 23 to a diameter of the greater-diameter portion 24.

The pin 20 is formed at a proximal end of the greater-diameter portion 24 with a connector ring 26 through which the pin 20 is connected with a necklace 80 (see FIG. 2).

As illustrated in FIGS. 1 and 2, the cylinder 30 is formed with a first hole 33 through which the pin 50 is inserted into the cylinder 30, and a second hole 34 through which the smaller-diameter portion 23 of the pin 20 is inserted into the cylinder 30. In addition, the cylinder 30 includes, as well as the above-mentioned stopper 31 and the releaser 32, a spring holder 35 around which the coil spring 40 is arranged, a spring-force receiver 36 on which the coil spring 40 acts a resilient force, an end 37 cooperating with the body 10 to defined an outer surface of the clasp 100, and a hole 38 formed at the end 37, and through which a sound generated when the stopper 31 is engaged to the pin 20 is emitted.

The cylinder 30 is in the form of a pin, and has a varying diameter. Specifically, as illustrated in FIG. 2, the cylinder 30 has a high-diameter portion 301, a middle-diameter portion 302 and a low-diameter portion 303 in this order.

The high-diameter portion 301 is formed with the end 37, which cooperates with the body 10 to define an outer surface of the clasp 100, for instance, an arcuate surface. Specifically, when the cylinder 30 is disposed in the body 10, the end 37 cooperates with the body 10 to define an outer surface of the clasp 100.

The first hole 33 through which the pin 50 is inserted extends perpendicularly to a longitudinal axis of the cylinder 30. The first hole 33 is formed longer than a diameter of the cylinder 51 of the pin 50 in directions F and E indicated in FIG. 1 such that the cylinder 30 can move in a direction in which the stopper 31 is engaged to the pin 50 and in the opposite direction, that is, in the directions F and E, even when the pin 50 is inserted through the cylinder 30. The first hole 33 is slightly longer than a diameter of the cylinder 51 of the pin 50 in a direction perpendicular to a plane defined by FIG. 1.

The second hole 34 through which the cylinder 20 is inserted extends perpendicularly to a longitudinal axis of the cylinder 30. The first and second holes 33 and 34 extend in parallel with each other. Accordingly, the pin 20 and the pin 50 extend through the cylinder 30 in parallel with each other. The second hole 34 is formed longer than a diameter of the smaller-diameter portion 23 of the pin 20 in the directions F and E such that the cylinder 30 can move in the directions F and E, even when the pin 20 is inserted through the cylinder 30, but is slightly longer than a diameter of the smaller-diameter portion 23 of the pin 20 in a direction perpendicular to a plane defined by FIG. 1.

The stopper 31 is comprised of a projection standing on an inner surface of the second hole 34 and extending towards an axis of the second hole 34. Specifically, the stopper 31 stands on the spring holder 35. The stopper 31 has an inclining surface 31*a* facing a hole 13 through which the pin 20 in inserted into the body 10. The inclining surface 31*a* guides the distal end 22 of the pin 20 into the second hole 34.

For instance, the first hole 33 is formed across the high-diameter portion 301 and the middle-diameter portion 302, and the second hole 34 is formed at the middle-diameter portion 302.

The spring holder 35 is formed in the low-diameter portion 303 in the vicinity of the middle-diameter portion 302. A diameter of the spring holder 35, that is, a diameter of the low-diameter portion 303 is slightly smaller than an inner diameter of the coil spring 40.

The spring-force receiver 36 on which the coil spring 40 acts a resilient force is comprised of a step defining a boundary between the low-diameter portion 303 and the middle-diameter portion 302.

The cylinder 30 is formed at an end thereof with the releaser 32. Specifically, the releaser 32 is formed at an end of the low-diameter portion 303. The releaser 32 is formed with a hole 32*a*. As illustrated in FIG. 2, the charm 60 is formed with a hole 60*a*. The hole 60*a* is connected to the hole 32*a* of the releaser 32 through a connector ring 61. Thus, a user can pinch the charm 60 to pull the releaser 32. For instance, the charm 60 is preferably a ball such as a pearl or a glass ball.

The hole 38 through which a sound is emitted is formed throughout the end 37 to reach the first hole 33. The hole 38 is omitted in FIG. 2.

As illustrated in FIGS. 1 and 2, the body 10 is in the form of an elliptic cylinder. The body 10 is formed with a hole 11 in which the cylinder 30, the coil spring 40 and the pin 50 are arranged, and in which the cylinder 30 is guided.

As mentioned later, the cylinder 30, the coil spring 40 and the pin 50 are inserted and arranged in the hole 11. The hole 11 is formed throughout the body 10.

In the body 10, a cylindrical wall 12 defining the hole 11 is formed integrally with the body 10.

The body 10 is formed with a hole 13 through which the pin 20 is inserted into the body 10. The hole 13 has a longitudinal axis in which the pin 20 is inserted into the body 10, and which is perpendicular to a direction in which the cylinder 30 is inserted into the hole 11. A direction in which the pin 20 is inserted into the body 10 and a direction in which the cylinder 30 is inserted into the hole 11 lie in a common plane.

The wall 12 is formed with a through-hole 12*a*. The pin 20 inserted through the hole 13 passes through the through-hole 12*a*. The through-hole 12*a* is tapered at an end facing the hole 13. Specifically, the through-hole 12*a* has a tapered portion 12*b* having a greater diameter at a location closer to the hole 13. The tapered portion 12*b* guides the distal end 22 of the pin 20 into a center of the through-hole 12*a*.

The body 10 has a first internal space 18 formed between the wall 12 and the hole 13, and a second internal space 19 formed beyond the wall 12. When inserted into the body 10, the pin 20 is disposed in the first and second internal spaces 18 and 19.

The wall 12 is formed with a pair of holes 14 and 15 for positioning the pin 50. Specifically, the second portions 52*b* of the pin 50 are positioned by the holes 14 and 15, and resultingly, the pin 50 is positioned.

The hole 15 which faces the hole 13 has an inner diameter slightly greater than an outer diameter of the second portion 52*b* of the pin 50.

The hole 14 has an inner diameter slightly greater than an outer diameter of the second portion 52*b* of the pin 50 in a direction perpendicular to a plane defined by FIG. 1, but sufficiently greater than an outer diameter of the second portion 52*b* in the directions E and F. That is, the hole 14 is elongated in the directions E and F. This is because to ensure an area in which the second portion 52*b* can be inclined, when the pin 50 is taken out of the hole 14.

The hole 15 leads to the hole 11 and the first internal space 18, and the hole 14 leads to the hole 11 and the second internal space 19.

The body 10 is formed at an outer surface thereof with a connector ring 16 through which the necklace (see FIG. 2) is connected to the body 10. The connector rings 16 and 26 are located in symmetry with each other about a center of the body 10.

The hole 11 has an end through which the releaser 32 projects, having an inner diameter smaller than an outer diameter of the coil spring 40. An inner surface 17 of the end of the hole 11 provides the coli spring 40 with a reaction force.

The coil spring 40 is comprised of a compressed coil spring.

The clasp 100 in accordance with the first embodiment is assembled as follows.

First, the pin 50 is inserted into the first hole 33 of the cylinder 30. Then, the coil spring 40 and the cylinder 30 are inserted into the hole 11 in a direction indicated with an arrow C in FIG. 2 such that the spring holder 35 is inserted into the coil spring 40.

When the pin 50 is inserted into the hole 11, the pin 50 is inclined such that one of the second portions 52*b* can be inserted into the hole 14, and the other second portion 52*b* kept in a contracted condition. The contracted second portion 52*b* is slid at a distal end thereof on an inner surface of the hole 11 to thereby insert the cylinder 30 into the hole 11.

After the pin 50 entered the hole 11, the end 37 is pushed in the direction C. As a result, when the contracted second portion 52*b* reaches the hole 15, the contracted second portion 52*b* extends into the hole 15 by virtue of the spring 53 disposed in the pin 50. Thus, the pin 50 is positioned as illustrated in FIG. 1.

Ceasing pushing the end 37 in the direction C, the cylinder 30 and the coil spring 40 are positioned as illustrated in FIG. 1.

When the pin 50 is arranged in the body 10 in such a manner as illustrated in FIG. 1, the cylinder 30, the pin 50 and the coil spring 40 do not fall off the body 10, even if a force for compressing the cylinder 30 in the direction E is ceased. This is because a pair of the second portions 52*b* of the pin 50 receives a reaction force from the holes 14 and 15, and a reaction force from the cylinder 30, and further because the coil spring 40 receives a reaction force from the spring-force receiver 36.

In FIG. 1, the coil spring 40 is sandwiched between the spring-force receiver 36 and the inner surface 17 of the end of the hole 11 in a compressed condition.

Thus, the releaser 32 is kept external of the body 10, and the end 37 cooperates with the body 10 to define an outer surface of the clasp 100.

The connector ring 61 may be connected to the hole 32*a* in a final step in the assembly process. As an alternative, if the connector ring 61 is smaller in size than an inner diameter of the hole 11, the connector ring 61 may be connected to the hole 32*a* before the cylinder 30 is inserted into the hole 11.

An operation of the clasp 100 is explained hereinbelow.

First, the engagement of the stopper 31 with the pin 20 is explained hereinbelow.

First, with reference to FIG. 2, the pin 20 is inserted through the distal end 22 thereof into the hole 13 of the body 10 in the direction D. Even if the distal end 22 is out of a center of the through-hole 12*a*, the tapered portion 12*b* guides the distal end 22 to a center of the through-hole 12*a*.

When, after the distal end 22 of the pin 20 was inserted into the second hole 34 and reached the stopper 31, the pin 20 is further inserted into the second hole 34, the stopper 31 is compressed by the tapered portion 22*a*, and moves in the direction E against a spring force generated by the coil spring 40. Whereas the cylinder 30 moves in the direction E together with the stopper 31, the pin 50 is kept stationary. Since the cylinder 30 moves in the direction E, the pin 50 relatively moves in the direction F opposite to the direction E in the second hole 34 relative to the cylinder 30.

Thereafter, the pin 20 is further inserted deeply into the body 10. When the groove 21 reaches the stopper 31, the stopper 31 is energized by the coil spring 40 to move in the direction F. Thus, the stopper 31 enters the groove 21. That is, the stopper 31 is engaged to the groove 21. When the stopper 31 moves, the cylinder 30 also moves in the direction F. Though the pin 50 does not move, since the cylinder 30 moves in the direction F, the pin 50 relatively moves in the direction E in the second hole 34 relative to the cylinder 30.

Thus, the stopper 31 is engaged to the pin 20 as illustrated in FIG. 1, ensuring that the pin 20 is prevented from releasing from the body 10.

Next, an operation for ceasing the engagement of the stopper 31 with the pin 20 is explained hereinbelow.

In order to release the pin 20 from the stopper 31, a user pulls the releaser 32 in the direction E. Specifically, the engagement of the stopper 31 with the pin 20 can be ceased by pulling the cylinder 30 including the releaser 32 in the direction E against a spring force provided by the coil spring 40. For instance, the releaser 32 may be pulled by pulling the charm 60. While the releaser 32 is being pulled, the pin 20 can be pulled out of the body 10 in the direction G.

In the clasp 100 in accordance with the first embodiment, it is possible to release the pin 20 from the stopper 31 by carrying out a novel and unique operation, that is, pulling the releaser 32.

An operation for exchanging a part into a new one for some reason is explained hereinbelow with reference to FIG. 4.

For instance, when any part is broken, or any part is exchanged to another ornamental part, part-exchange operation is carried out.

Figure 4:
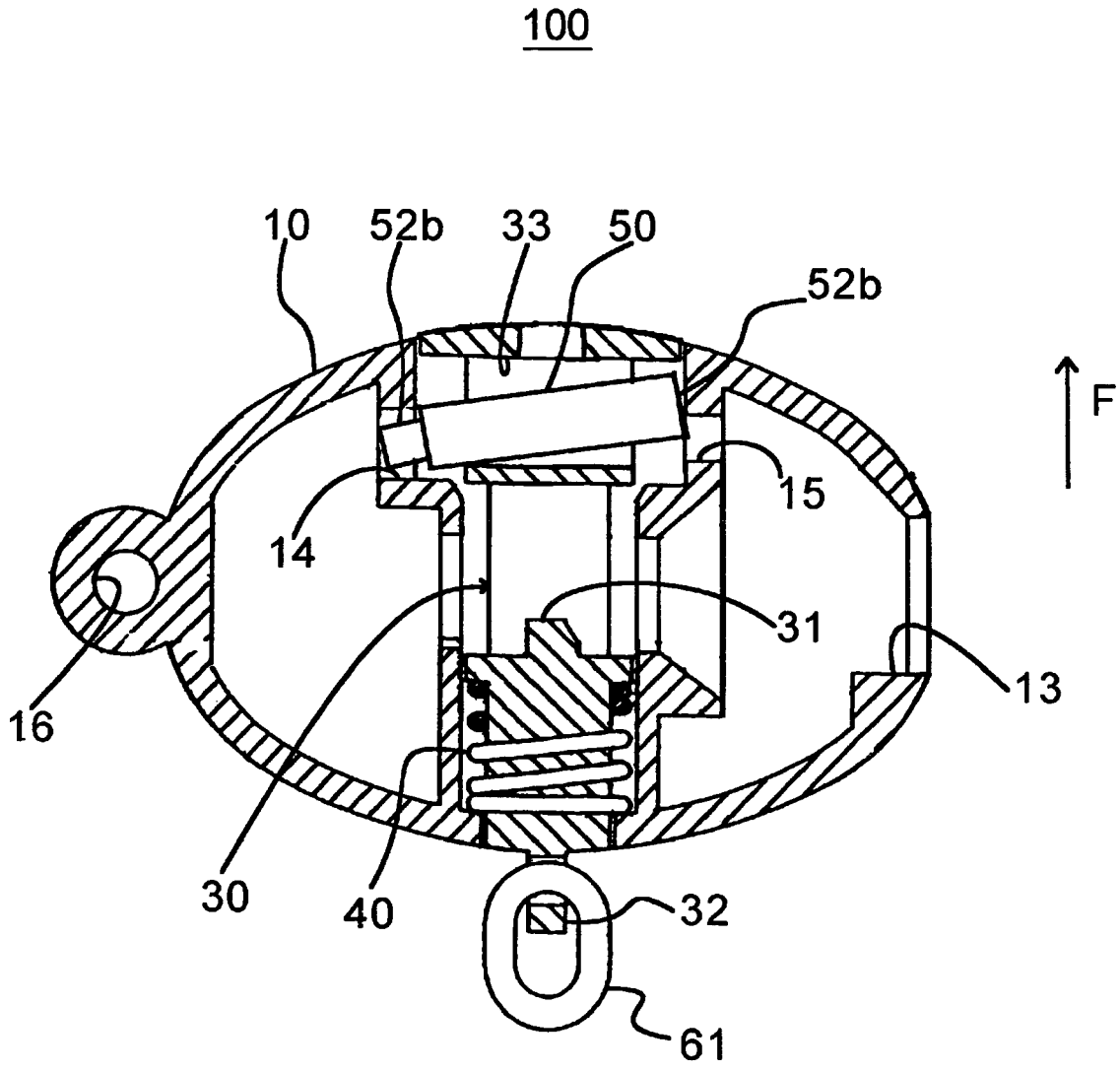
FIG. 4 is a cross-sectional view of the clasp in accordance with the first embodiment of the present invention.

A part is exchanged to another part while the pin 20 is pulled out of the body 10, as illustrated in FIG. 4.

While the pin 20 is pulled out of the body 10, a pin (not illustrated. For instance, see FIG. 20) is inserted into the hole 15 through the first internal space 18. Then, one of the second portions 52*b* is contracted with a distal end of the pin. As a result, as illustrated in FIG. 4, the end of the pin 50 at which the one of the second portions 52*b* is contracted moves in the direction F in FIG. 4 by a spring force provided by the coil spring 40, and accordingly, the pin 50 is inclined in the first hole 33. The other second portion 52*b* is inclined in the hole 14.

The end of the pin 50 at which the one of the second portions 52*b* is contracted further moves in the direction F along an inner wall of the hole 11 by a spring force provided by the coil spring 40, and resultingly, the pin 50 is further inclined. As the pin 50 moves, the cylinder 30 moves in the direction F.

Thus, not only the pin 50, but also the cylinder 30 and the coil spring 40 can be taken out of the hole 11. Thus, any one or more of the pin 50, the coil spring 40, the cylinder 30 and the body 10 may be replaced with a new one.

In accordance with the above-mentioned first embodiment, since the engagement of the pin 20 with the stopper 31 can be ceased merely by pulling the releaser 32, a user would feel no pain in his/her finger, even if the releaser 32 is small in size.

Furthermore, since the pin 20 can be released from the stopper 31 by carrying out a novel and unique operation, that is, pulling the releaser 32, users' attraction can be drawn with respect to a function.

In addition, since the cylinder 30 and the coil spring 40 can be assembled to the body 10 by means of a single pin 50, it would be possible to fabricate the clasp 100 with the small number of parts, readily assemble the clasp 100, and readily replace a part with a new one.

Furthermore, since the pin 50 is entirely disposed within the body 10, and hence, is not exposed to a user, the clasp 100 could have good looking.

Furthermore, the hole 38 makes it possible for a user to listen to a sound generated when the stopper 31 is engaged to the pin 20. Thus, a user can check whether the stopper 31 is surely engaged to the pin 20.

Since the end 37 cooperates with the body 10 to define an outer surface of the clasp 100, it would be possible to enhance designability of the clasp 100 by differentiating the cylinder 30 from the body 10 with respect to a color and/or a material of which they are composed.

The parts constituting the clasp 100 can be assembled with one another after they are plated or decorated. Thus, the parts can be beautifully plated or painted, and the parts can be painted with different colors.

Though the body 10 in the first embodiment is in the form of an elliptic cylinder, the body 10 may be in any form. For instance, the body 10 may be rectangular parallelepiped or spherical.

The hole 38 is formed at the end 37 in the first embodiment. It should be noted that the hole 38 may be formed at the body 10, or at both the end 37 and the body 10. Furthermore, a plurality of the holes 38 may be formed at the end 37 and/or the body 10.

Second Embodiment

Figure 5:
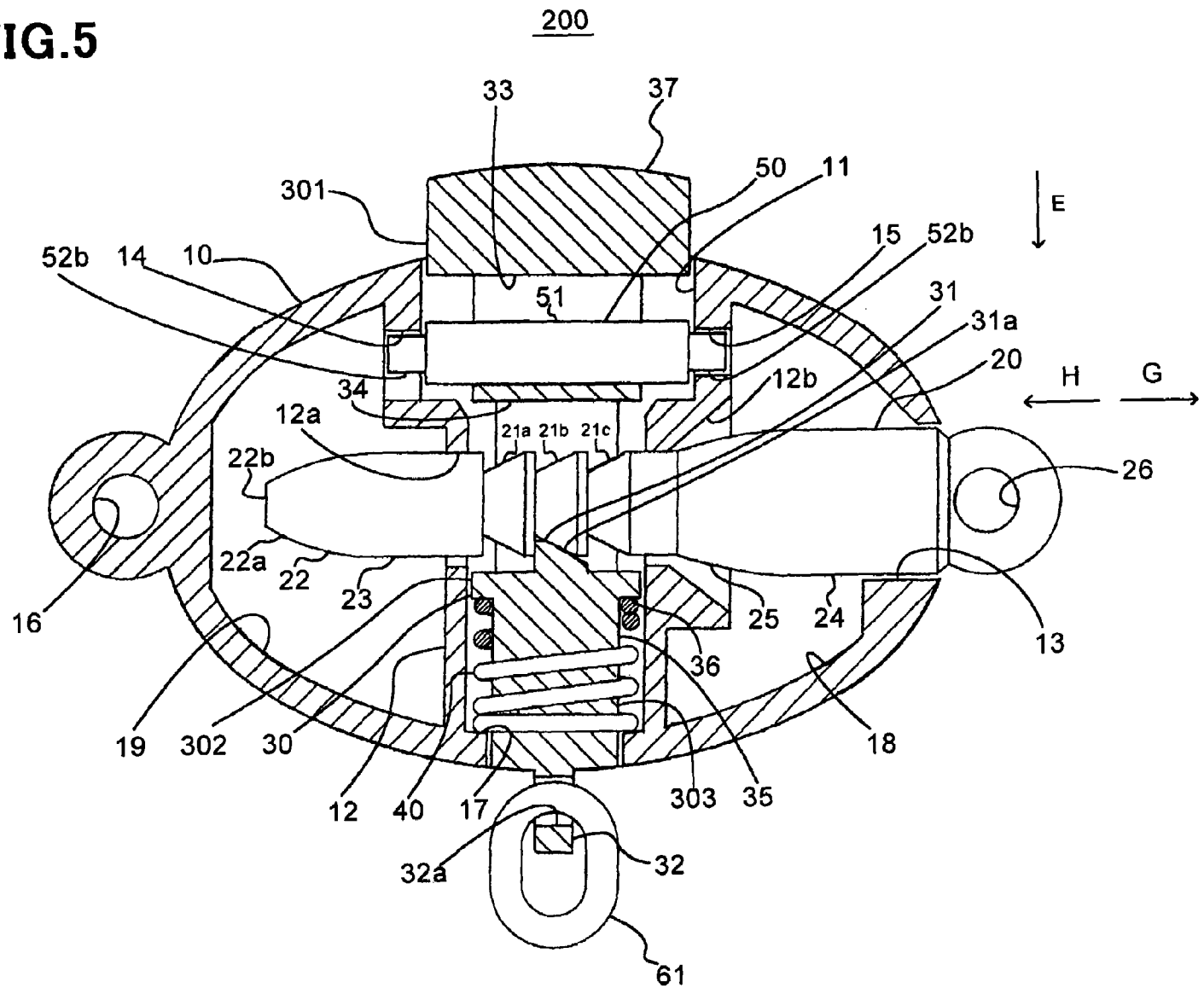
FIG. 5 is a cross-sectional view of the clasp in accordance with the second embodiment of the present invention.

FIG. 5 is a cross-sectional view of a clasp 200 in accordance with the second embodiment of the present invention.

Hereinbelow is explained the clasp 200 with reference to FIG. 5.

The clasp 200 is structurally different from the clasp 100 in accordance with the first embodiment only in what is explained later. Hence, parts or elements that correspond to clasp 100 have been provided with the same reference numerals, and are not explained.

As illustrated in FIG. 5, the end 37 in the second embodiment is formed thicker than the end 37 in the first embodiment, and projects outwardly beyond the body 10 accordingly. Thus, the end 37 defines a second releaser.

Specifically, it is possible to release the pin 20 from the stopper 3.1 by pulling the releaser 32 in the direction E and pushing the end 37 acting as a second releaser in the direction E. As an alternative, the pin 20 can be released from the stopper 31 by pushing the end 37 in the direction E or pulling the releaser 32 in the direction E.

The pin 20 in the second embodiment is formed with a plurality of grooves 21*a* to 21*c* arranged longitudinally of the pin 20.

Since the stopper 31 may be engaged to any one of the grooves 21*a* to 21*c*, it would be possible to control a length of the necklace 80 (see FIG. 2), that is, a length in the directions G and H in FIG. 5.

In addition, it would be possible to control a length of the pin 20 projecting outwardly beyond the body 10. Thus, among a plurality of the-bodies 10 having different lengths between the stopper 31 and the hole 13, a preferable one can be selected.

By causing the stopper 31 to be engaged to the groove 21*b* or 21*c*, if the stopper 31 is accidentally released from the pin 20, the stopper 31 would be engaged again to the groove 21*a* or 21*b*, respectively, keeping the pin 20 engaged to the body 10. Thus, it is possible to reduce possibility that the necklace 80 (see FIG. 2) connected to the clasp 200 accidentally drops out of the clasp 200.

Each of the grooves 21*a* to 21*c* has a diameter reducing towards the distal end 22 of the pin 20. Accordingly, when the pin 20 is inserted in the direction H, the stopper 31 can readily shift to an adjacent groove, but the stopper 31 is unlikely to release from the groove, even when the pin 20 is pulled in the direction G.

A critical strength at which the pin 20 is released from the stopper 31 when the pin 20 is pulled in the direction G is determined in dependence on an angle and a height of the grooves 21*a* to 21*c*, and a strength of the coil spring 40.

Though the hole 38 is omitted in FIG. 5, the end 37 may be formed at the end 37, the body 10, or both the end 37 and the body 10, similarly to the first embodiment.

The second embodiment provides the same advantages as those provided by the first embodiment, and provides the additional advantages as follows.

In the second embodiment, since the end 37 acts as a second releaser, a user could have increased options for releasing the pin 20 from the stopper 31.

Furthermore, since the pin 20 has a plurality of the grooves 21*a* to 21*c*, it would be possible to vary a length of the necklace 80, and to listen to a plurality of sounds generated when the stopper 31 is engaged to the grooves 21*a* to 21*c*.

Though the pin 20 in the second embodiment is designed to have three grooves 21*a* to 21*c*, it should be noted that the pin 20 may be designed to have any number of the grooves.

Third Embodiment

Figure 6:
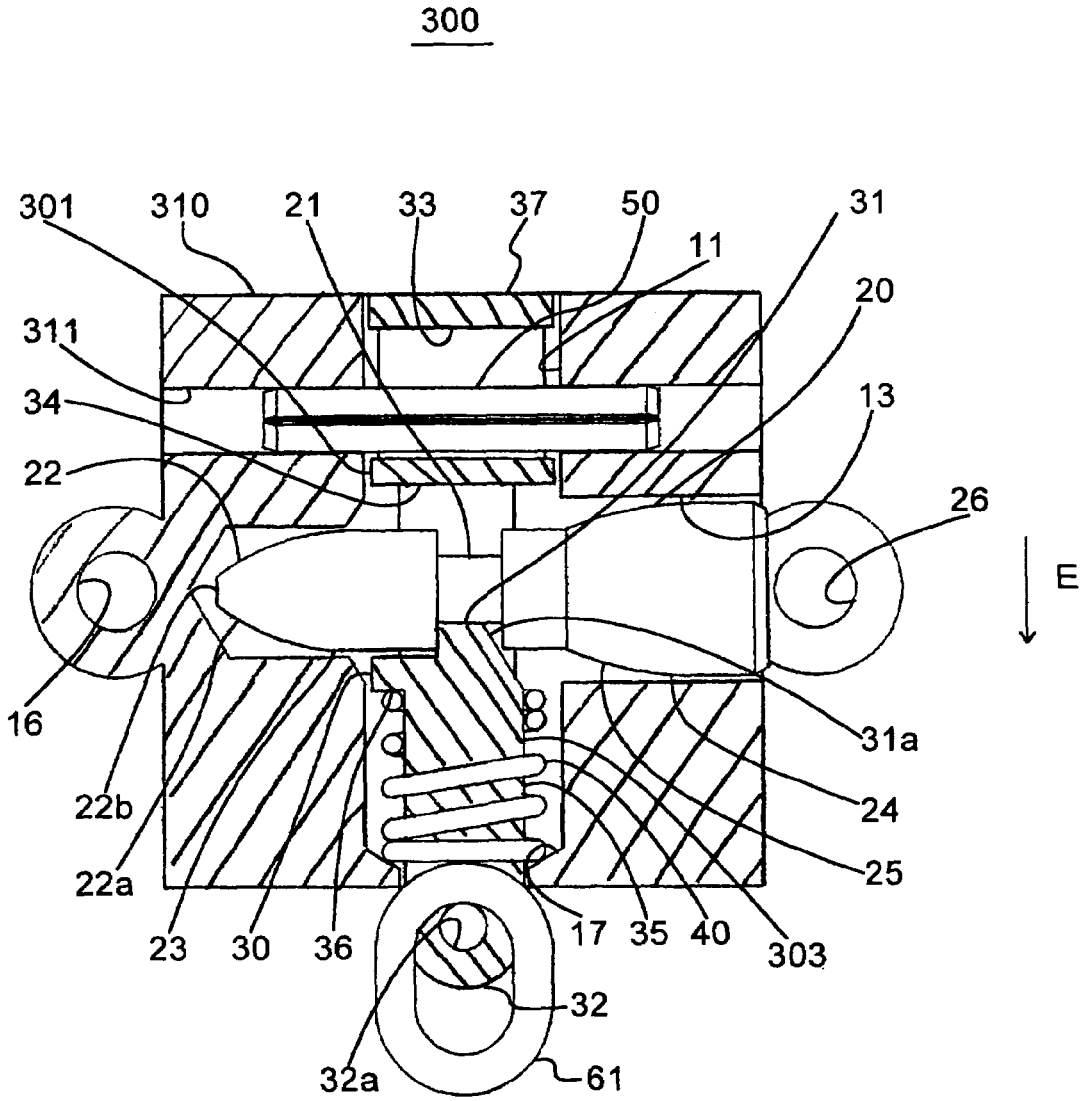
FIG. 6 is a cross-sectional view of the clasp in accordance with the third embodiment of the present invention.

FIG. 6 is a cross-sectional view of a clasp 300 in accordance with the third embodiment of the present invention.

Hereinbelow is explained the clasp 300 with reference to FIG. 6.

The clasp 300 is structurally different from the clasp 100 in accordance with the first embodiment only in what is explained later. Hence, parts or elements that correspond to clasp 100 have been provided with the same reference numerals, and are not explained.

The pin 50 in the first and second embodiments is comprised of such a spring bar as illustrated in FIG. 3. The pin 50 in the third embodiment is comprised of such a spring pin as illustrated in FIG. 7.

Figure 7:
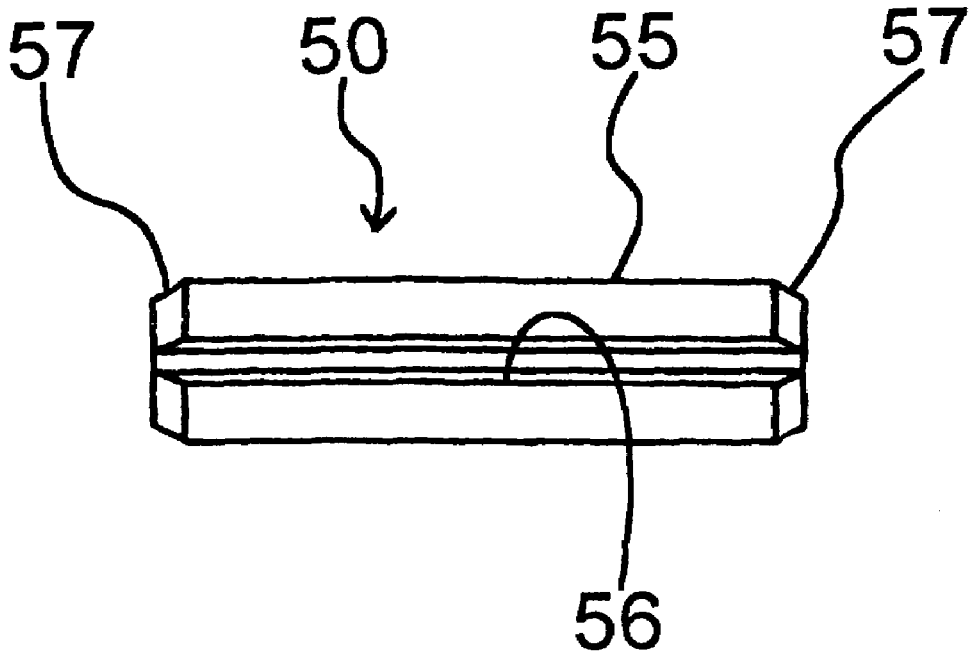
FIG. 7 is a front view of a pin used in the clasp in accordance with the third embodiment of the present invention.

The pin 50 illustrated in FIG. 7 is comprised of a cylindrical body 55 formed with a cut-out 56 extending longitudinally thereof. The cylindrical body 55 has chamfered ends 57 so as to be thin at opposite ends.

The pin 50 is fixedly inserted into a hole (for instance, a later mentioned hole 311), if the hole has a diameter almost equal to or slightly smaller than a diameter of the pin 50. The chamfered ends 57 facilitate the pin 50 to be inserted into such a hole.

The clasp 300 includes a rectangular parallelepiped body 310 in place of the elliptic-cylinder body 10.

The body 310 is formed with a hole 311 therethrough in place of the holes 14 and 15. The pin 50 is inserted into the hole 311. The hole 311 extends in parallel with an axis of the pin 20.

The hole 13 in the third embodiment intersects with the hole 11 in the body 310, and extends beyond the hole 11. That is, the hole 13 partially acts as the first and second internal spaces 18 and 19 in the first embodiment.

The cylinder 30 in the third embodiment is designed to be comprised of a high-diameter portion 301 and a low-diameter portion 303, and does not include a middle-diameter portion 302 unlike the first embodiment. The first and second through-holes 33 and 34 in the third embodiment are formed at the high-diameter portion 301. The spring holder 35 is formed at the low-diameter portion 303 in the vicinity of the high-diameter portion 301. The spring-force receiver 306 which the coil spring 40 energizes is defined by a step formed between the low-diameter portion 303 and the high-diameter portion 301.

Thus, the hole 11 in the third embodiment is formed in accordance with an outer shape of the cylinder 30. Though the hole 11 in the first embodiment is formed by the wall 12, the hole 11 in the third embodiment is formed by drilling the body 310, for instance.

The end 37 in the third embodiment is flat such that the end 37 cooperated with the body 310 to form an outer surface of the clasp 300.

The clasp 300 in accordance with the third embodiment is assembled as follows.

First, the coil spring 40 and the cylinder 30 are inserted into the hole 11 of the pin 50 in a direction indicated with an arrow E in FIG. 6 such that the spring holder 35 is inserted into the coil spring 40.

Then, the pin 50 is inserted into the hole 311 until the pin 50 reaches such a position as illustrated in FIG. 6.

Ceasing pushing the cylinder 30 in the direction E, the cylinder 30 and the coil spring 40 are positioned as illustrated in FIG. 6.

When the pin 50 is arranged in the body 310 in such a manner as illustrated in FIG. 6, the cylinder 30, the pin 50 and the coil spring 40 do not fall off the body 310, even if a force for compressing the cylinder 30 in the direction E is ceased. This is because the pin 50 receives a reaction force from the hole 311, the pin 50 receives a reaction force from the cylinder 30, and the coil spring 40 receives a reaction force from the spring-force receiver 36.

In FIG. 6, the coil spring 40 is sandwiched between the spring-force receiver 36 and the inner surface 17 of the end of the hole 11 in a compressed condition.

Thus, the releaser 32 is kept external of the body 310, and the end 37 cooperates with the body 310 to define an outer surface of the clasp 300.

The stopper 31 is engaged to the pin 20 and the stopper 31 is released from the pin 20 in the same manner as the first embodiment.

A part of the clasp 300 can be exchanged to a new one by inserting a pin (not illustrated) into the hole 311 to thereby push the pin 50 out of the hole 311.

The clasp 300 in accordance with the third embodiment provides the same advantages as those provided by the first embodiment. In addition, since the pin 50 as illustrated in FIG. 7 is used, the clasp 300 can be readily assembled.

The pin 20 in the third embodiment may be designed to have a plurality of the grooves 21, similarly to the second embodiment. The body 310 and/or the end 37 may be formed with the hole 38 through which a sound generated when the stopper 31 is engaged to the pin 20 is emitted.

The body 310 may be in any form. For instance, the body 310 may be cylindrical, elliptically cylindrical, or spherical.

The pin 50 illustrated in FIG. 7 may be applied to the body 10 in the first embodiment.

Fourth Embodiment

Figure 8:
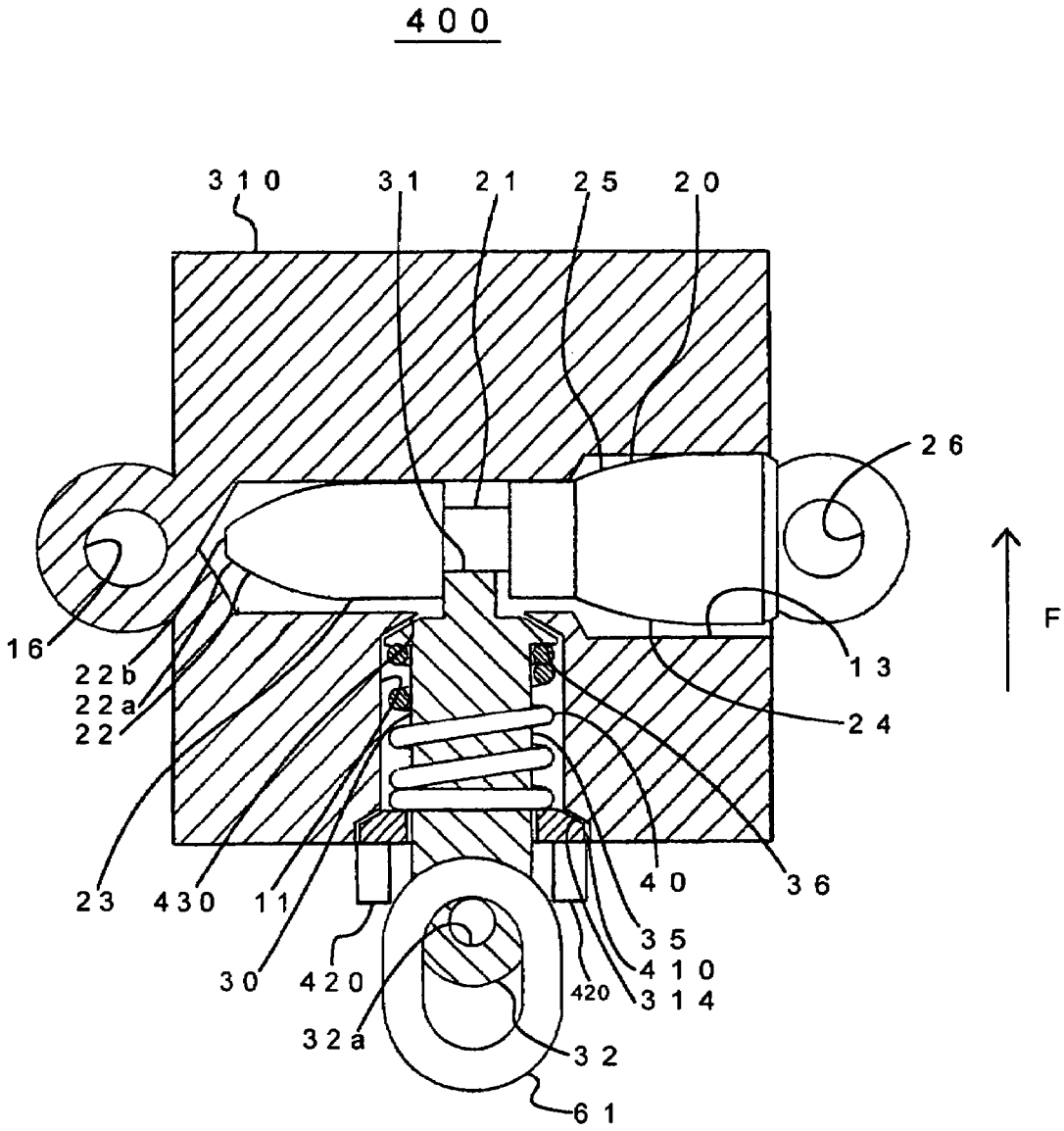
FIG. 8 is a cross-sectional view of the clasp in accordance with the fourth embodiment of the present invention.

FIG. 8 is a cross-sectional view of a clasp 400 in accordance with the fourth embodiment of the present invention.

Hereinbelow is explained the clasp 400 with reference to FIG. 8.

The clasp 400 is structurally different from the clasp 300 in accordance with the third embodiment only in what is explained later. Hence, parts or elements that correspond to clasp 300 have been provided with the same reference numerals, and are not explained.

In the above-mentioned first to third embodiments, the cylinder 30 and the coil spring 40 are assembled to the body 10 or 310 by means of the pin 50. In the fourth embodiment, the cylinder 30 and the coil spring 40 are assembled to the body without using the pin 50.

The body 310 in the fourth embodiment is structurally different from the body 310 in the third embodiment as follows.

The hole 11 in the fourth embodiment does not pass through the body 310. Specifically, the hole 11 has a depth to reach the hole 13. Furthermore, the body 310 is not formed with the hole 311 and the inner surface 17 of the end of the hole 11.

The body 310 is formed with a restrictor 430 for restricting movement of the cylinder 30 in the direction F. The restrictor 430 is formed by designing a boundary portion between the hole 11 and the hole 13 to have a smaller diameter than a diameter of the spring-force receiver 36 of the cylinder 30.

The body 310 is formed with a recess 314 in which a later mentioned ring 410 is positioned. The recess 314 is formed by designing an opening end of the hole 11 to have a greater diameter than a diameter of the rest of the hole 11.

As illustrated in FIG. 8, the ring 410 is a ring into which the cylinder 30 is inserted, and which has a diameter smaller than a diameter of the coil spring 40.

The body 310 is formed with stands 420 extending from an edge of the opening end of the hole 11. The stands 420 are deformed to cover the ring 410 therewith, after the ring 410 has been positioned in the recess 314, for fixing the ring 410 to the body 310.

The cylinder 30 in the fourth embodiment is structurally different from the cylinder 30 in the third embodiment.

The cylinder 30 in the fourth embodiment longitudinally has an almost constant diameter except the spring-force receiver 36, unlike the cylinder 30 in the third embodiment having the high-diameter portion 301 and the low-diameter portion 303.

The spring-force receiver 36 outwardly extends around the cylinder 30 to have a diameter greater than a diameter of the spring holder 35.

The cylinder 30 in the fourth embodiment is not formed with the end 37, and the first and second through-holes 33 and 34. Hence, the stopper 31 is disposed at a top of the cylinder 30.

The clasp 400 in accordance with the fourth embodiment is assembled as follows.

First, the spring holder 35 of the cylinder 30 is inserted into the coil spring 40, and then, the cylinder 30 is inserted into the ring 410. Then, the connector ring 61 is connected to the hole 32*a*.

Then, the cylinder 30, the coil spring 40 and the ring 410 are inserted into the hole 11 in the direction F in FIG. 8.

Then, with the ring 410 being positioned in the recess 314, the stands 420 are deformed to thereby fix the ring 410 to the body 310. FIG. 8 illustrates the stands 420 before deformed.

After the clasp 400 has been assembled in the above-mentioned manner, even if pushing the ring 410 in the direction F is ceased, the cylinder 30, the coil spring 40 and the ring 410 do not fall off the body 310. This is because the coil spring 40 receives a reaction force from the ring 410, and further because the cylinder 30 receives a reaction force from the coil spring 40.

Since the movement of the cylinder 30 is restricted by the restrictor 430, the cylinder 30 cannot move in the direction F beyond a position illustrated in FIG. 8. The coil spring 40 is sandwiched between the spring-force receiver 36 and the ring 410 in a compressed condition. The releaser 32 is kept external of the body 310.

The stopper 31 is engaged to the pin 20 and the stopper 31 is released from the pin 20 in the same manner as the first embodiment.

The clasp 400 in accordance with the fourth embodiment provides the same advantages as those provided by the third embodiment. In addition, since the cylinder 30 and the coil spring 40 are fixed to the body 310 by means of the stands 420, the body 310 and the cylinder 30 can be simplified relative to those in the third embodiment.

The pin 20 in the fourth embodiment may be designed to have a plurality of the grooves 21, similarly to the second embodiment. The body 310 may be formed with the hole 38 through which a sound generated when the stopper 31 is engaged to the pin 20 is emitted.

The body 310 may be in any form. For instance, the body 310 may be cylindrical, elliptically cylindrical, or spherical.

Fifth Embodiment

Figure 9:
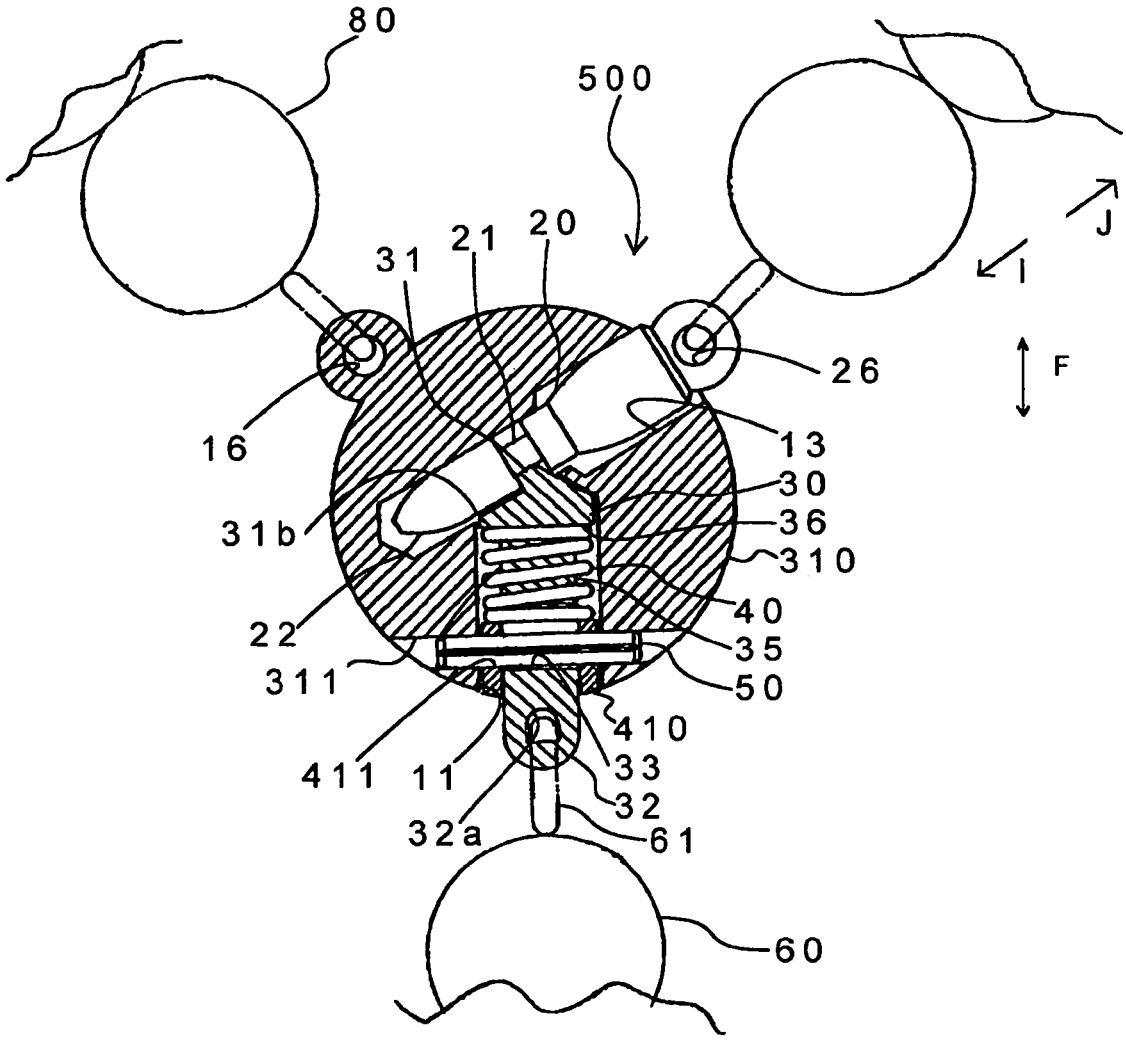
FIG. 9 is a cross-sectional view of the clasp in accordance with the fifth embodiment of the present invention.

FIG. 9 is a cross-sectional view of a clasp 500 in accordance with the fifth embodiment of the present invention.

Hereinbelow is explained the clasp 500 with reference to FIG. 9.

The clasp 500 is structurally different from the clasp 300 in accordance with the third embodiment only in what is explained later. Hence, parts or elements that correspond to clasp 300 have been provided with the same reference numerals, and are not explained.

The body 310 in the fifth embodiment is structurally different from the body 310 in the third embodiment as follows.

The hole 11 in the fifth embodiment does not pass through the body 310. Specifically, the hole 11 has a depth to reach the hole 13. Furthermore, the body 310 is not formed with the inner surface 17 of the end of the hole 11.

The hole 311 in the third embodiment is formed at the opposite side of the coil spring 40 with respect to the hole 13. In contrast, the hole 311 in the fifth embodiment is formed at the same side as the coil spring 40 with respect to the hole 13.

The hole 13 extends in a direction different from the direction in which the hole 13 in the third embodiment extends. Specifically, whereas the hole 13 in the third embodiment extends perpendicularly to the hole 11, the hole 13 in the fifth embodiment extends obliquely relative to the hole 11.

The connector ring 16 in the fifth embodiment is disposed in line-symmetry with the connector ring 26 of the pin 20 about an axis of the hole 11.

The body 310 in the fifth embodiment is spherical (or cylindrical).

The cylinder 30 in the fifth embodiment is more similar in structure to the body 310 in the fourth embodiment than the body 310 in the third embodiment. Hence, the cylinder 30 in the fifth embodiment is explained in comparison with the body 310 in the fourth embodiment.

The cylinder 30 in the fifth embodiment is structurally different from the body 310 in the fourth embodiment as follows.

The stopper 31 in the fifth embodiment is inclined relative to the stopper 31 in the fourth embodiment so as to extend perpendicularly to an axis of the hole 13. The cylinder 30 has a surface 31*b* on which the stopper 13 is formed. The surface 31*b* is inclined in comparison with the same in the fourth embodiment, and extends in parallel with an axis of the hole 13.

The cylinder 30 is formed with a first hole 33 through which the pin 50 is inserted. The first hole 33 is formed closer to the releaser 32 than the spring holder 35.

The ring 410 in the fifth embodiment is structurally different from the same in the fourth embodiment as follows.

The ring 410 in the fifth embodiment is formed with a through-hole 411 through which the pin 50 is inserted. As illustrated in FIG. 9, a length of the ring 411 and a position of the through-hole 411 are determined such that an end of the ring 410 defines a part of a surface of the body 310, when the pin 50 is inserted into the through-hole 411 and the hole 311.

The through-hole 411 has an inner diameter having no play relative to an outer diameter of the pin 50. In contrast, the first hole 33 has a diameter greater than a diameter of the pin 50 in a direction in which the pin 50 relatively moves, in order to ensure an area for the pin 50 to relatively move, similarly to the above-mentioned embodiments.

The clasp 500 in accordance with the fifth embodiment is assembled as follows.

The spring holder 35 is inserted into the coil spring 40, and the cylinder 30 is inserted into the ring 410. Then, the connector ring 61 is connected to the hole 32*a*.

Then, the cylinder 30, the coil spring 40 and the ring 410 are inserted into the hole 11 in the direction F in FIG. 9.

After the ring 410 has been positioned such that the end thereof is flat with a surface of the body 310, as illustrated in FIG. 9, the pin 50 is inserted into the hole 311 until the pin 50 reaches a location illustrated in FIG. 9, that is, until the pin 50 passes through the through-hole 411 of the ring 410.

After the pin 50 has been arranged as illustrated in FIG. 9, even if pushing the ring 410 in the direction F is ceased, the cylinder 30, the coil spring 40 and the ring 410 do not fall off the body 310. This is because the pin 50 receives a reaction force from the hole 311, the ring 410 receives a reaction force from the pin 50, the coil spring 40 receives a reaction force from the ring 410, and the spring-force receiver 36 of the cylinder 30 receives a reaction force from the coil spring 40.

In the condition illustrated in FIG. 9, the coil spring 40 is sandwiched between the spring-force receiver 36 and the ring 410 in a compressed condition. The releaser 32 is kept external of the body 310.

The stopper 31 is engaged to the pin 20 and the stopper 31 is released from the pin 20 in the same manner as the first embodiment.

A part of the clasp 500 can be exchanged to a new one by inserting a pin (not illustrated) into the hole 311 to thereby push the pin 50 out of the hole 311.

The clasp 500 in accordance with the fifth embodiment provides the same advantages as those provided by the third and fourth embodiments.

As illustrated in FIG. 9, a direction in which the pin 20 is inserted is inclined in comparison with the same in FIGS. 6 and 8, and the connector ring 16 is disposed in symmetry with the connector ring 26 of the pin 20. Hence, a user could put the necklace 80 around his/her neck in a natural angle.

The body 310 may be in any form, and may be formed with the hole 38 through which a sound generated when the stopper 31 is engaged to the pin 20 is emitted.

The pin 20 may be designed to have a plurality of the grooves 21. Hereinbelow is explained an example of the grooves 21 with reference to FIG. 10.

Figure 10:
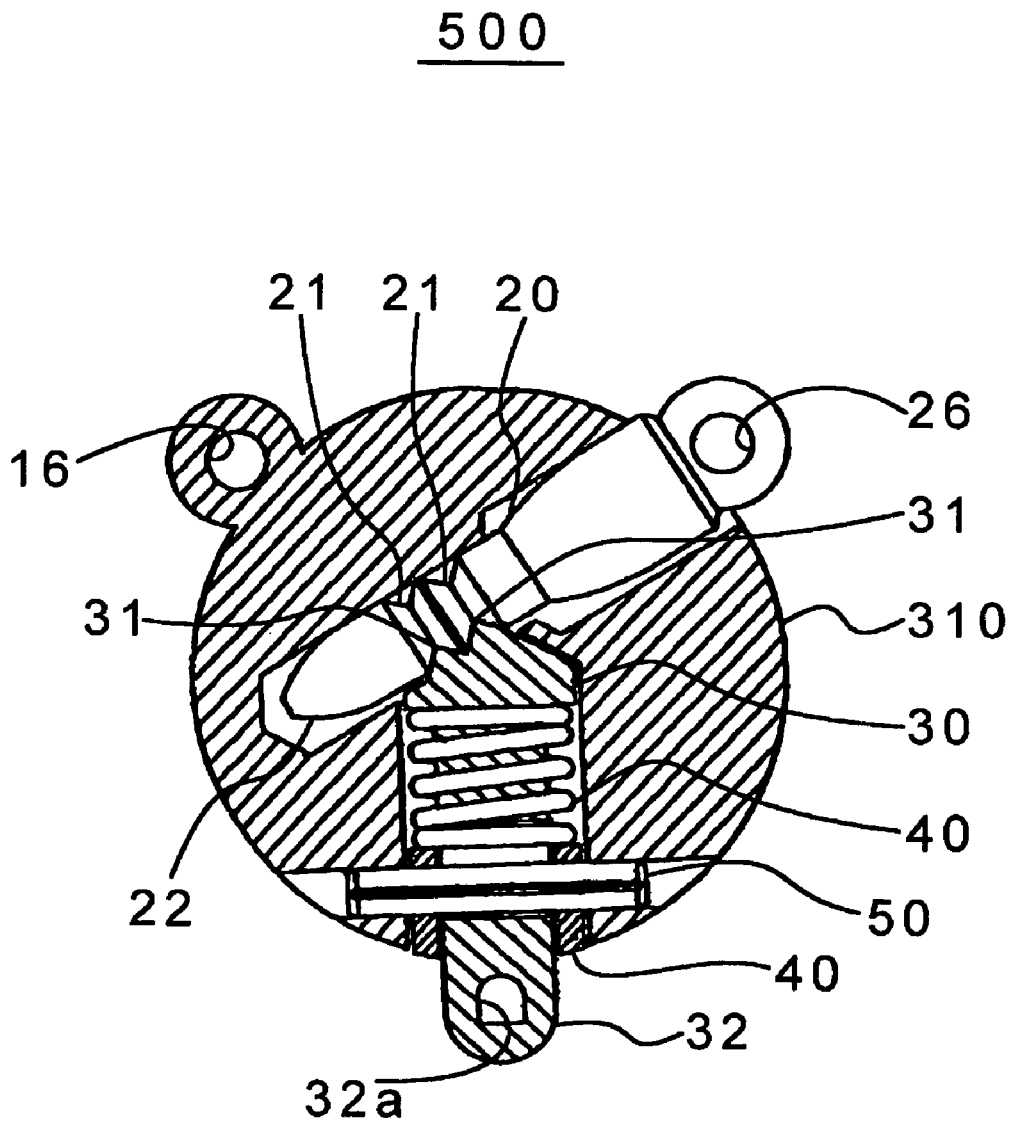
FIG. 10 is a cross-sectional view of the clasp in accordance with a variant of the first embodiment of the present invention.

In the example illustrated in FIG. 10, the pin 20 includes the two grooves 21, and the cylinder 30 includes the two stoppers 31 each of which is engaged to each of the grooves 21.

The grooves 21 are slightly different from the grooves 21*a* to 21*c* illustrated in FIG. 5. Specifically, the grooves 21 illustrated in FIG. 10 are in the form of a valley, or V-shaped. In other words, each of the V-shaped grooves 21 has a diameter increasing both towards the distal end 22 of the pin 20 and towards a proximal end of the pin 20 from a bottom of a valley.

In accordance with a shape of the grooves 21, the stoppers 31 are in the form of a mountain, or reverse-V-shaped. Hence, when the pin 20 is inserted into the hole 13 in the direction I (see FIG. 9), the stoppers 31 are readily engaged to the grooves 21, and are released from the grooves 21 when the pin 20 is strongly pulled in the direction J (see FIG. 9). This is because, if the stoppers 31 are strongly engaged to the grooves 21, a user may be choked with the necklace 80 for some reasons. Such a problem can be solved by designing the stoppers 31 to be released from the grooves 21 when a force having certain strength acts on the pin 20, as in the example illustrated in FIG. 10.

The V-shaped grooves 21 and the reverse-V-shaped stoppers 31 may be applied to the above-mentioned first to fourth embodiments.

The number of the grooves 21 and the stoppers 31 is not to be limited to two. The pin 20 may include any number of the grooves 21, in which case, the cylinder 30 includes the stoppers 31 in the same number as the grooves 21.

Sixth Embodiment

Figure 11:
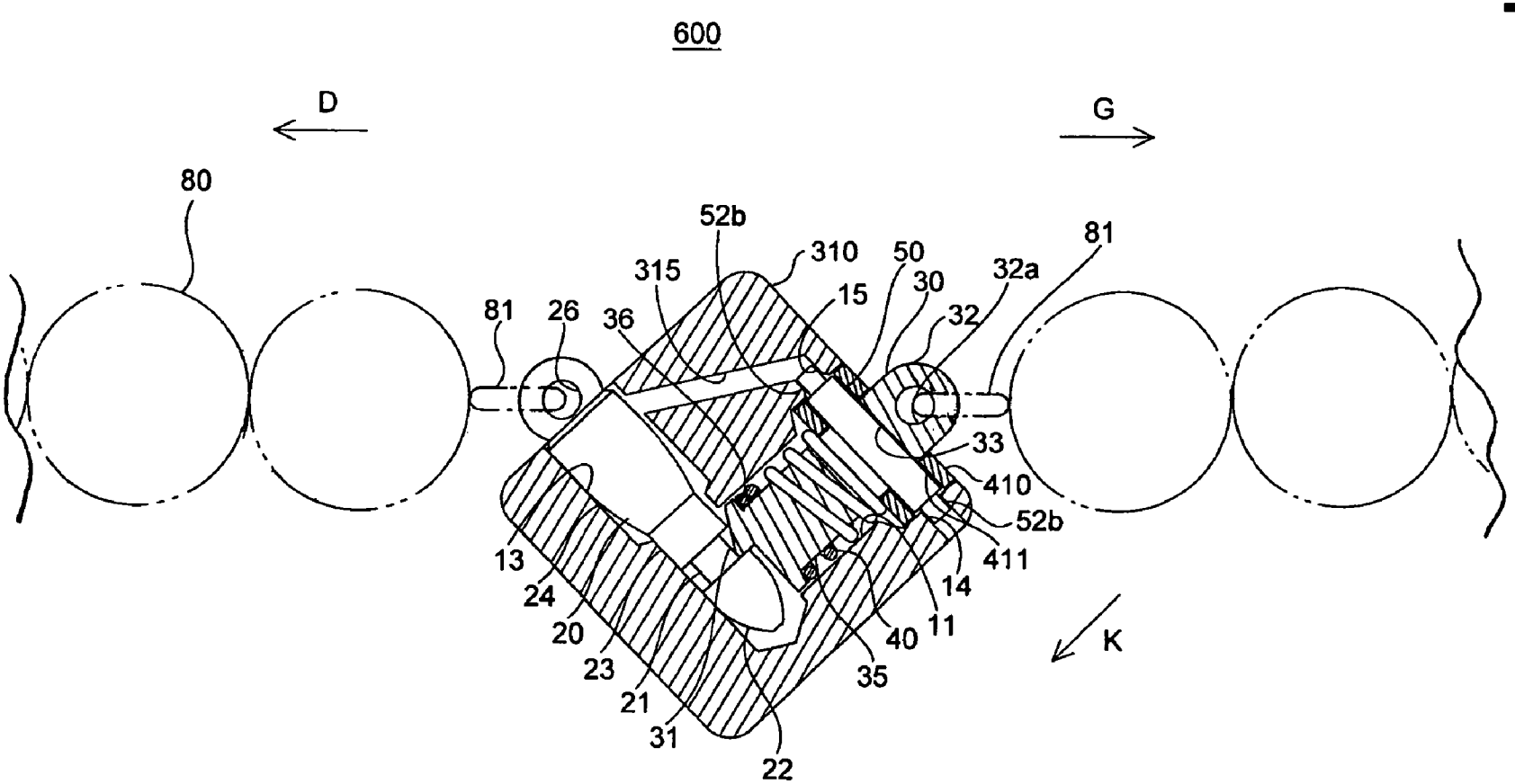
FIG. 11 is a cross-sectional view of the clasp in accordance with the sixth embodiment of the present invention.

FIG. 11 is a cross-sectional view of a clasp 600 in accordance with the sixth embodiment of the present invention.

Hereinbelow is explained the clasp 600 with reference to FIG. 11.

The clasp 600 is structurally different from the clasp 500 in accordance with the fifth embodiment only in what is explained later. Hence, parts or elements that correspond to clasp 500 have been provided with the same reference numerals, and are not explained.

The body 310 in the sixth embodiment includes holes 14 and 15 in place of the hole 311. The hole 14 leads outside of the body 310, and the hole 15 leads to the hole 13 through a later mentioned hole 315.

The holes 11 and 13 in the sixth embodiment extend perpendicularly to each other, similarly to the above-mentioned third embodiment. Accordingly, the stopper 31 of the cylinder 30 extends in the same manner as that of the above-mentioned third embodiment.

The body 310 does not include the connector ring 16. The body 310 is rectangular parallelepiped. The pin 50 in the sixth embodiment is comprised of a spring bar.

The clasp 600 in accordance with the sixth embodiment is assembled as follows.

The spring holder 35 is inserted into the coil spring 40, and the cylinder 30 is inserted into the ring 410. Then, a connector ring 81 is connected to the hole 32*a*.

Then, the ring 410 is pushed towards the stopper 31 to thereby compress the coil spring 40 and further make a through-hole 411 of the ring 410 align with the first through-hole 33 of the cylinder 30.

Then, the pin 50 inserted into the hole 14 such that the pin 50 passes through the first through-hole 33 and the through-hole 411.

Then, the cylinder 30, the coil spring 40, the ring 410 and the pin 50 are inserted into the hole 11 in the direction K in FIG. 11. When the pin 50 is inserted into the hole 11, the second portions 52*b* are contracted, and then distal ends of the second portions 52*b* are made slide along an inner wall of the hole 11. After the pin 50 has entered the hole 11, the releaser 32 is kept pushed in the direction K.

When the contracted second portions 52*b* reach the holes 14 and 15, the second portions 52*b* project into the holes 14 and 15 by a spring force provided by the spring 53, and thus, the cylinder 30, the coil spring 40, the ring 410 and the pin 50 are arranged as illustrated in FIG. 11.

The stopper 31 is engaged to the pin 20 and the stopper 31 is released from the pin 20 in the same manner as the first embodiment.

A part of the clasp 600 can be exchanged to a new one as follows.

First, the pin 20 is released from the body 310. Then, a pin (not illustrated) is inserted into the hole 15 through the holes 13 and 315 to thereby contract one of the second portions 52*b* of the pin 50. Then, another pin (not illustrated) is inserted into the hole 14 to thereby contract the other second portion 52*b*. With the second portions 52*b* being kept contracted, the releaser 32 is pulled out of the body 310. Thereafter, any part of the clasp 600 can be exchanged to a new one.

The clasp 600 in accordance with the sixth embodiment provides the same advantages as those provided by the third and fourth embodiments.

Since the body 310 does not include the connector ring 16, the body 310 may be composed of non-metal material such as artificial resin (plastic), wood or ceramics.

Furthermore, since the body 310 is formed with the hole 315, a user could readily exchange a part to a new one.

For instance, even when the necklace 80 is pulled in the directions G and D for some reason, since the directions G and D intersect with both a direction in which the pin 20 is inserted and a direction in which the cylinder 30 moves, the stopper 31 is unlike to be released from the groove 21.

If the necklace 80 is connected at its opposite ends to the connector ring 26 and the hole 32*a*, the pin 20 can be pulled out of the body 310 by pulling an end of the necklace 80 at which the necklace 80 is connected to the releaser 32.

The body 310 in the sixth embodiment may be in any form. The body 310 may be designed to include a plurality of the grooves 21.

Seventh Embodiment

Figure 12:
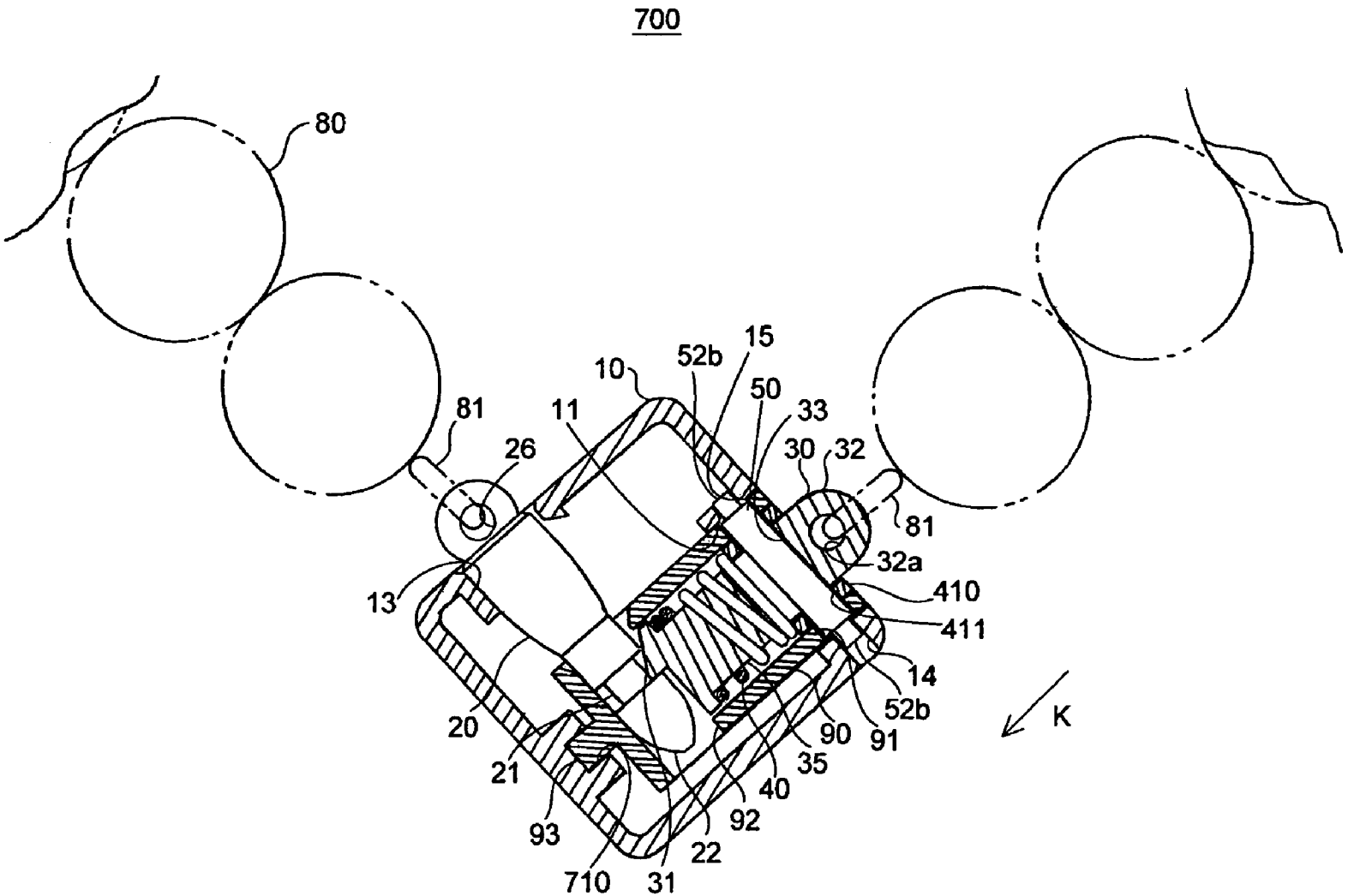
FIG. 12 is a cross-sectional view of the clasp in accordance with the seventh embodiment of the present invention.

FIG. 12 is a cross-sectional view of a clasp 700 in accordance with the seventh embodiment of the present invention.

Hereinbelow is explained the clasp 700 with reference to FIG. 12.

The clasp 700 is structurally different from the clasp 600 in accordance with the sixth embodiment only in what is explained later. Hence, parts or elements that correspond to clasp 600 have been provided with the same reference numerals, and are not explained.

The clasp 700 includes a body 10 in place of the body 310.

The body 10 is formed the hole 13, the hole 11, the hole 14 and the hole 15.

The clasp 700 further includes a cylindrical guide 90 for guiding therein the cylinder 30. The cylindrical guide 90 is in the form of a cylinder open at one of ends thereof. The cylindrical guide 90 is formed with a through-hole 91 through which the pin 50 passes, and a hole 92 into which the pin 20 is inserted.

The cylindrical guide 90 is formed at a distal end thereof with a projection 93 which is to be positioned by a recess 710 formed at an inner wall of the body 10.

The clasp 700 in accordance with the seventh embodiment is assembled as follows.

The spring holder 35 is inserted into the coil spring 40, and the cylinder 30 is inserted into the ring 410. Then, a connector ring 81 is connected to the hole 32*a*.

Then, the cylinder 30, the coil spring 40 and the ring 410 are inserted into the cylindrical guide 90.

Then, the ring 410 is pushed towards the stopper 31 to thereby compress the coil spring 40 and further make a through-hole 411 of the ring 410 align with the first through-hole 33 of the cylinder 30 and the through-hole 91 of the cylindrical guide 90.

Then, the pin 50 is inserted into the through-hole 91, the first through-hole 33 and the through-hole 411.

Then, the cylindrical guide 90, the cylinder 30, the coil spring 40, the ring 410 and the pin 50 are inserted into the hole 11 in the direction K in FIG. 12 such that the projection 93 of the cylindrical guide 90 goes ahead.

When the pin 50 is inserted into the hole 11, the second portions 52*b* are contracted, and then distal ends of the second portions 52*b* are made slide along an inner wall of the hole 11. After the pin 50 has entered the hole 11, the releaser 32 is kept pushed in the direction K.

Then, the projection 93 is inserted into the recess 710.

When the contracted second portions 52*b* reach the holes 14 and 15, the second portions 52*b* project into the holes 14 and 15 by a spring force provided by the spring 53, and thus, the cylindrical guide 90, the cylinder 30, the coil spring 40, the ring 410 and the pin 50 are arranged as illustrated in FIG. 12.

The stopper 31 is engaged to the pin 20 and the stopper 31 is released from the pin 20 in the same manner as the first embodiment.

A part of the clasp 700 can be exchanged to a new one as follows.

First, the pin 20 is pulled out of the body 310. Then, a pin (not illustrated) is inserted into the hole 15 through the hole 13 to thereby contract one of the second portions 52*b* of the pin 50. Then, another pin (not illustrated) is inserted into the hole 14 to thereby contract the other second portion 52*b*. With the second portions 52*b* being kept contracted, the releaser 32 is pulled out of the body 310. Thereafter, any part of the clasp 700 can be exchanged to a new one.

The clasp 700 in accordance with the seventh embodiment provides the same advantages as those provided by the sixth embodiment.

In addition, the clasp 700 can be formed lighter than the clasps 100 to 600 in accordance with the above-mentioned first to sixth embodiments.

The body 310 in the seventh embodiment may be in any form. The body 310 may be designed to include a plurality of the grooves 21, and to have the hole 38 through which a sound generated when the stopper 31 is engaged to the pin 20 is emitted.

Eighth Embodiment

A clasp 800 in accordance with the eighth embodiment is explained hereinbelow with reference to FIGS. 13 to 20.

Figure 13:
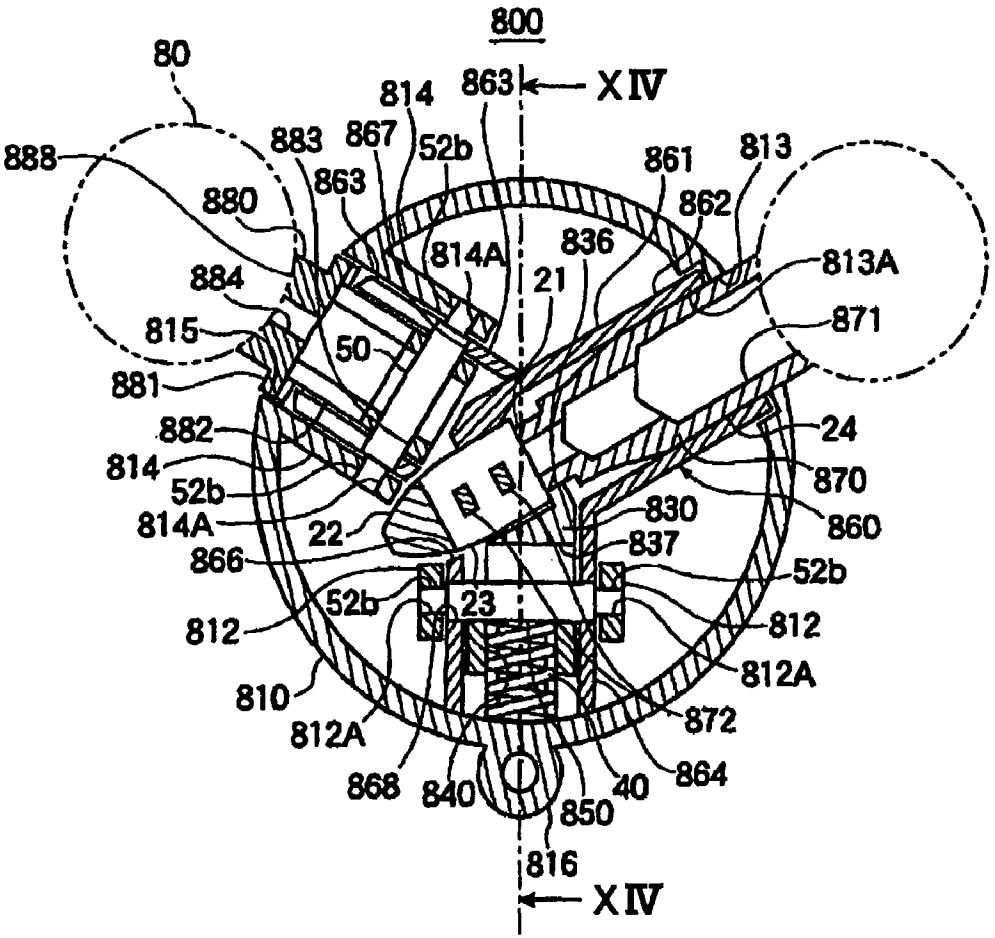
FIG. 13 is a cross-sectional view of the clasp in accordance with the eighth embodiment of the present invention.
Figure 14:
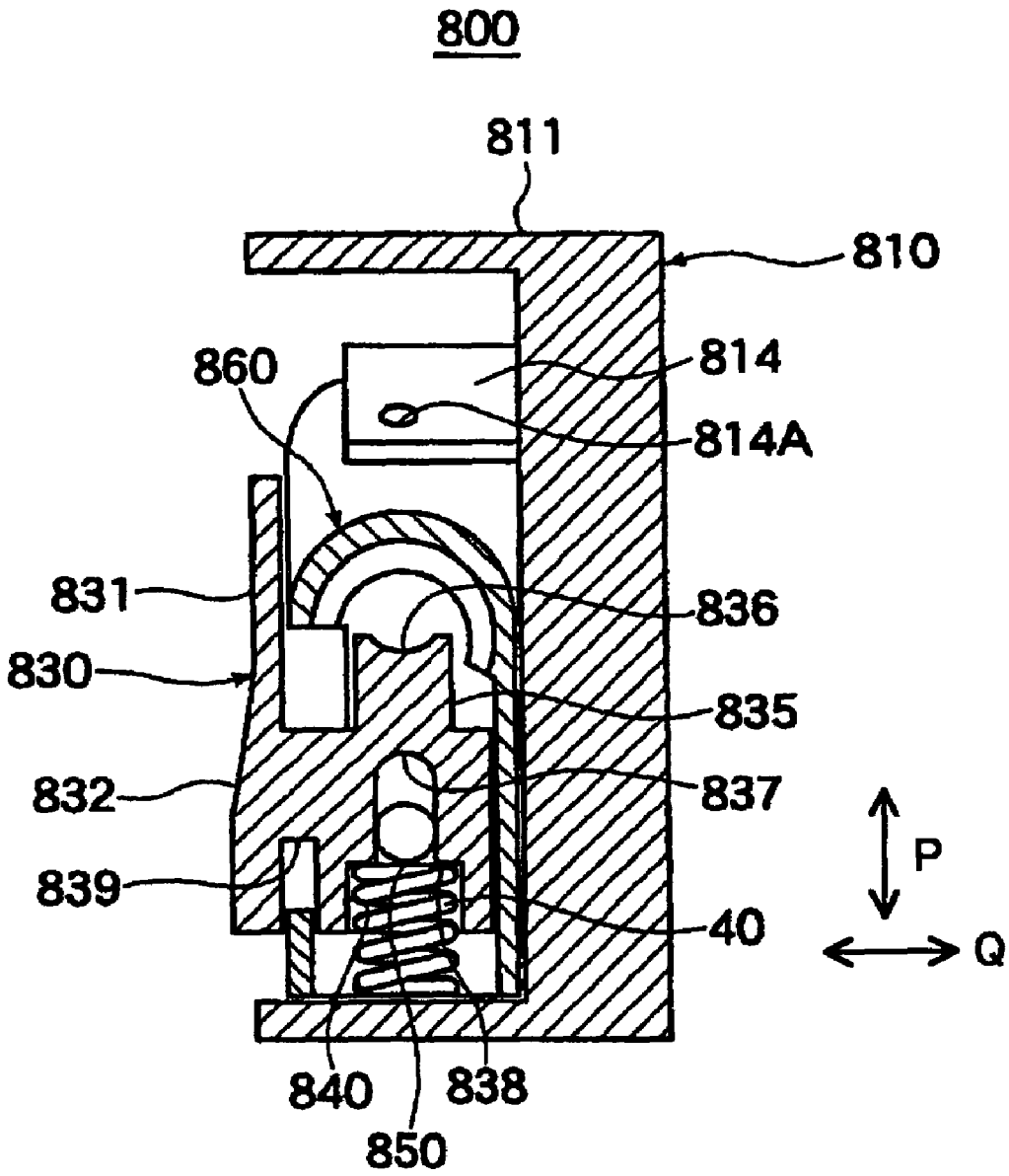
FIG. 14 is a cross-sectional view taken along the line XIV-XIV in FIG. 13.
Figure 15:
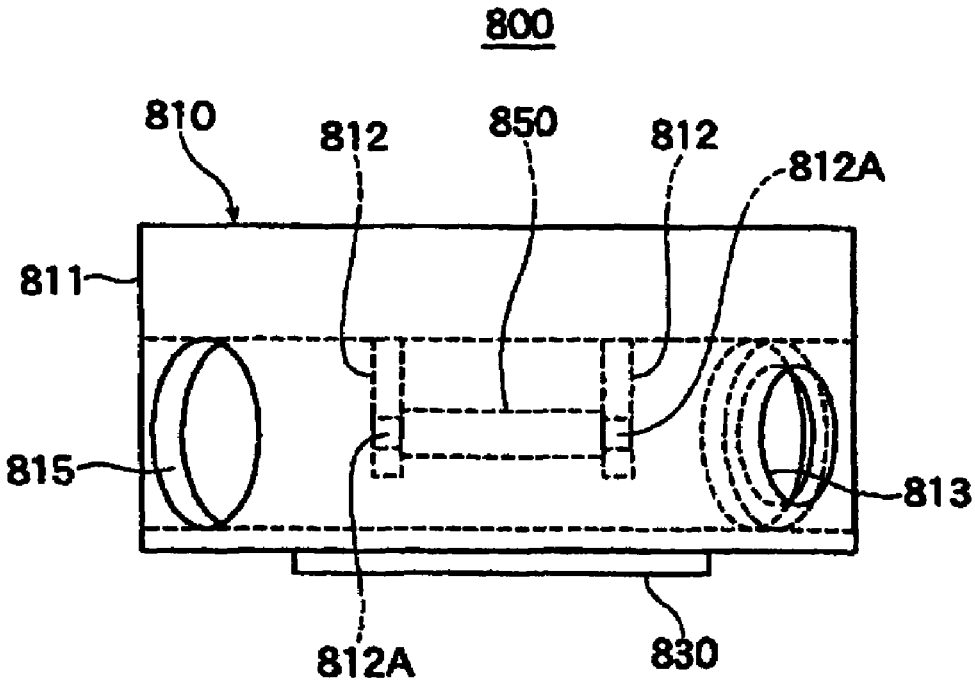
FIG. 15 is an upper view of the clasp in accordance with the eighth embodiment of the present invention.
Figure 16:
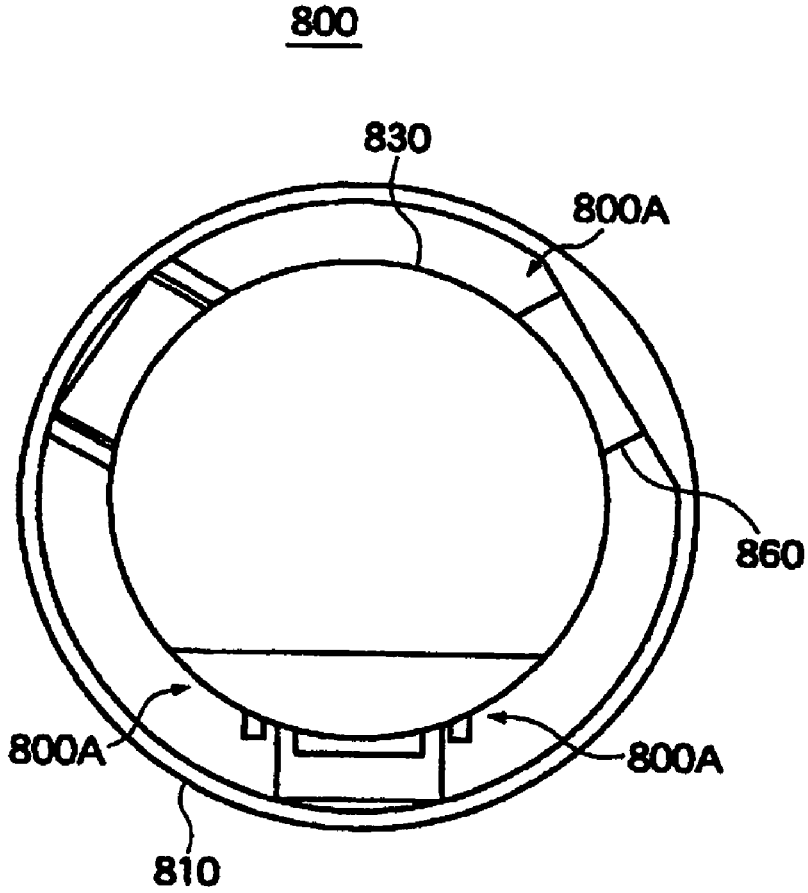
FIG. 16 is a rear view of the clasp in accordance with the eighth embodiment of the present invention.
Figure 17:
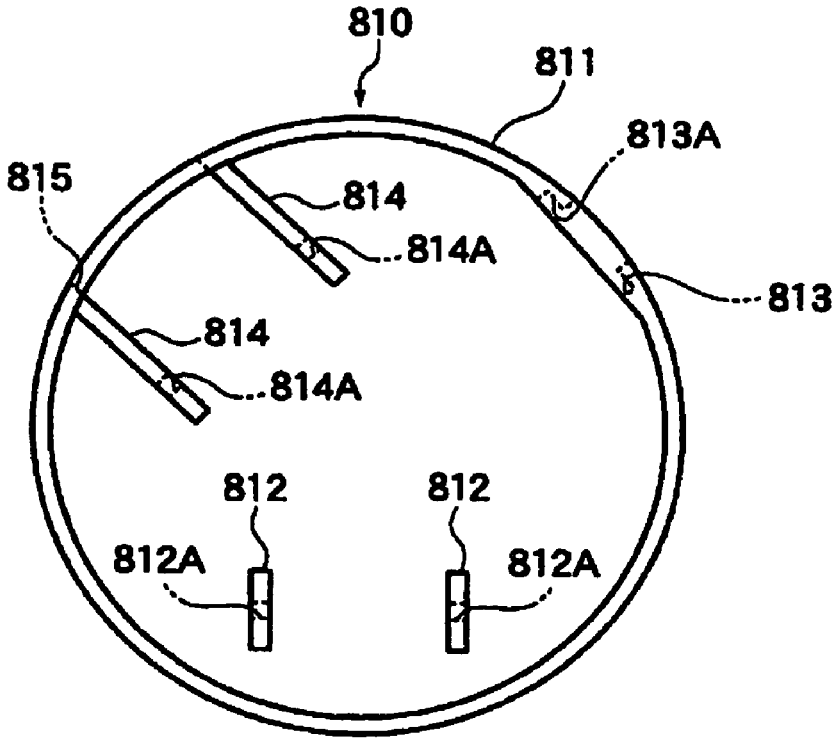
FIG. 17 is a rear view of a body in the clasp in accordance with the eighth embodiment of the present invention.
Figure 18:
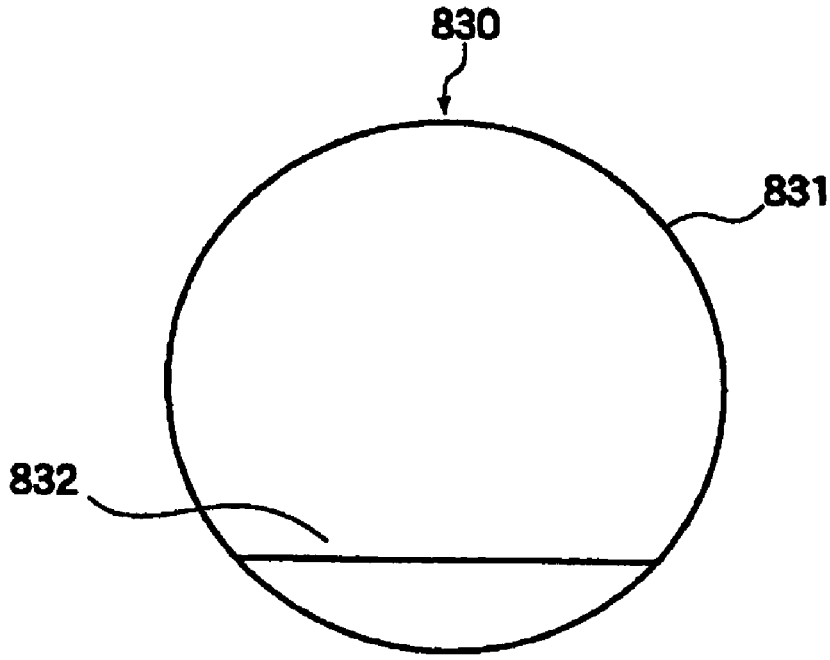
FIG. 18 is a rear view of a cylinder in the clasp in accordance with the eighth embodiment of the present invention.
Figure 19:
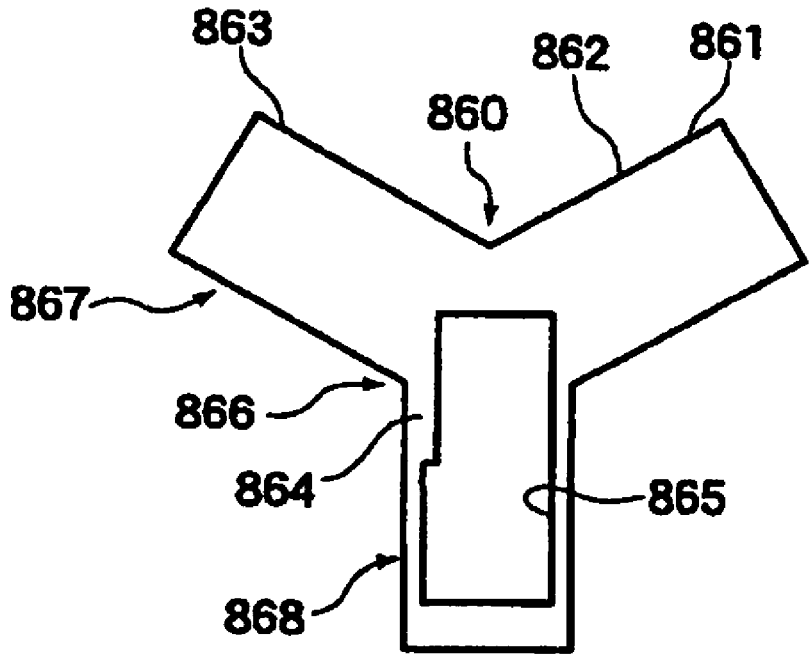
FIG. 19 is a rear view of a Y-shaped case in the clasp in accordance with the eighth embodiment of the present invention.
Figure 20:
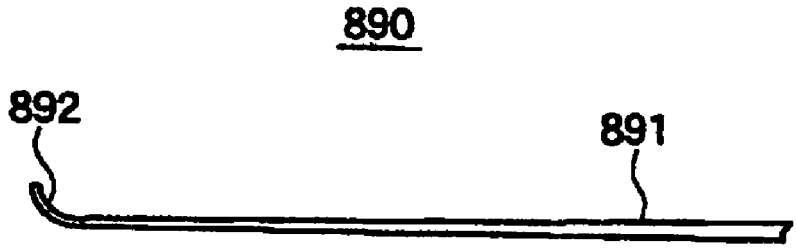
FIG. 20 is a plan view of a tool used for releasing pins from a body in the clasp in accordance with the eighth embodiment of the present invention.

FIG. 13 is a cross-sectional view of the clasp 800. FIG. 14 is a cross-sectional view taken along the line XIV-XIV in FIG. 13. FIG. 15 is an upper view of the clasp 800. FIG. 16 is a rear view of the clasp 800. FIG. 17 is a rear view of a body in the clasp 800. FIG. 18 is a rear view of a cylinder in the clasp 800. FIG. 19 is a rear view of a Y-shaped case in the clasp 800. FIG. 20 is a plan view of a tool used for releasing pins from a body in the clasp 800.

In the above-mentioned first to seventh embodiments, the pin 20 is released from the stopper 31 by pulling the releaser 32. In contrast, a pin is released from a stopper by sliding a releaser in the eighth embodiment.

As illustrated in FIG. 13, the clasp 800 is comprised of a body 810, a pin 870 to be inserted into the body 810, a stopper 836 engaging to the pin 870 having been inserted into the body 810 to keep the pin 870 engaged to the body 810, a releaser 832 (see FIG. 14) which ceases engagement of the stopper 836 with the pin 870 to thereby release the pin 870 from the body 810, a cylinder 830 formed integrally with the releaser 832 and the stopper 836, a coil spring 40 energizing the cylinder 830, an almost Y-shaped case 860 disposed in the body 810, a connector 880 detachably connecting a necklace 80 to the body 810, a pin 50, and a pin 850 fixing the case 860 in the body 810 together with the pin 50.

As illustrated in FIG. 14, the stopper 836 and the releaser 832 are formed integrally with each other. Specifically, each of the stopper 836 and the releaser 832 defines a portion of the cylinder 830. The cylinder 830 is movable relative to and in the body 810.

As illustrated in FIG. 13, the pin 870 is inserted into the case 860, and is kept not released from the case 860 by the stopper 836.

The pin 850 not only fixes the case 860 in the body 810, but also prevents the cylinder 830 and the coil spring 40 from dropping out of the body 810. The pin 50 not only fixes the case 860 in the body 810, but also prevents the connector 880 from dropping out of the body 810.

The pin 50 in the eighth embodiment has the same structure as that of the first embodiment. The pin 850 has the same structure as that of the pin 50. Hence, parts or elements in the pin 850 that correspond to those of the pin 50 have been provided with the same reference numerals.

The pin 870 has the same structure as that of the pin 20 in the first embodiment except what is explained later. Hence, parts or elements in the pin 870 that correspond to those of the pin 20 have been provided with the same reference numerals.

The pin 20 in the first embodiment has the connector ring 26 through which the necklace 80 is connected to the pin 20. In contrast, the pin 870 does not include the connector ring 26, but is formed with a hollow space 871 through which a wire is inserted. Furthermore, the pin 870 is formed in the smaller-diameter portion 23 with beams 872 around which a wire is wound.

Balls such as pearls constituting the necklace 80 are connected to one another by inserting a wire through the balls. An end of the wire is inserted into the pin 870 through the hollow space 871, and then is wound around the beams 872 for connecting the necklace 80 to the pin 870.

A structure of the pin 870 is not to be limited to the above-mentioned one. For instance, the pin 20 in the first embodiment may be used in place of the pin 870.

As illustrated in FIGS. 18 and 14, the cylinder 830 is comprised of a body 831 in the form of a circular plate, and a front 835 (see FIG. 14) connected to the body 831 through a neck 839 (see FIG. 14) and located in front of the body 831.

The releaser 832 is formed as a slope at the rear of the front 831.

The front 835 is disposed in the case 860 as mentioned later.

The front 835 is formed with the above-mentioned stopper 836, a through-hole 837 in which the pin 850 is disposed, a recess 840 in which the coil spring 40 is disposed, and a spring-force receiver 838 receiving a force provided from the coil spring 40.

The through-hole 837 has a length sufficiently greater than a diameter of the pin 850 in a direction P (see FIG. 14) such that the cylinder 830 is movable in the direction P even when the pin 850 is inserted in the through-hole 837, but slightly greater than a diameter of the pin 850 in a direction Q perpendicular to the direction P.

As illustrated in FIG. 19, the case 860 include an almost Y-shaped body 861. The Y-shaped body 861 is hollow, and is comprised of a first portion 862, a second portion 863, and a third portion 864 radially extending in a common plane to by 120 degrees.

As illustrated in FIG. 13, the pin 870 is inserted into the first portion 862. The distal end 22 of the pin 870 having been inserted into the first portion 862 projects beyond an opening 866 formed at an intersection of the second and third portions 863 and 864, as illustrated in FIG. 13.

The connector 880 is inserted into the second portion 863.

The second portion 863 is formed with a pair of cut-outs 867 into which the pin 50 is to be inserted through an opening of the second portion 863.

The second portion 863 of the case 860 is fixed to the body 810 by the pin 50 together with the connector 880 inserted into the second portion 863.

The front 835 of the cylinder 830 is disposed in the third portion 864. Specifically, the third portion 864 is formed at a rear wall thereof with an opening 865 (see FIG. 19) through which the front 835 of the cylinder 830 is arranged into the third portion 864.

The third portion 864 is formed with a through-hole 868 (see FIG. 13) into which the pin 850 is inserted.

The third portion 864 is fixed to the body 810 by means of the pin 850 inserted into the through-hole 868.

The pin 850 not only fixes the third portion 864 to the body 810, but also prevents the cylinder 830 and the coil spring 40 from dropping out of the body 810. The coil spring 40 is kept compressed between the spring-force receiver 838 of the cylinder 830 and an inner surface of the body 810.

As illustrated in FIG. 13, the connector 880 is almost cylindrical, and is comprised of a main body 882 to be inserted into the second portion 863 of the case 860, a flange 881 formed at an opening end of the second portion 863 and having a diameter slightly greater than a diameter of the main body 882, and a ball receiver 888 on which a ball (such as pearl) of the necklace 80 lies.

The ball receiver 888 is formed with a hole 884 through which a wire passes, and the main body 882 is formed with a through-hole 883 into which the pin 50 is inserted.

As illustrated in FIGS. 13 to 17, the body 810 is comprised of a circular body 811, a pair of walls 812 standing on an inner surface of the circular body 811, and another pair of walls 814 standing on an inner surface of the circular body 811.

The walls 812 set the third portion 864 in a predetermined position, and are spaced away from each other by a distance slightly greater than an outer diameter of the third portion 864. Each of the walls 812 is formed with a hole 812A for positioning the second portions 52*b* of the pin 850.

The walls 814 set the second portion 863 in a predetermined position, and are spaced away from each other by a distance slightly greater than an outer diameter of the second portion 863. Each of the walls 814 is formed with a hole 814A for positioning the second portions 52*b* of the pin 50.

As illustrated in FIGS. 13, 15 and 17, the circular body 811 is formed at a circumferential wall thereof with a hole 815 through which the main body 882 of the connector 880 is guided into the second portion 863 of the case 860 disposed in the body 810, and a hole 813 through which the pin 870 is guided into the first portion 862 of the case 860 disposed in the body 810.

The hole 813 is comprised of a greater-diameter portion and a smaller-diameter portion disposed inside. This structure enables a step 813A formed between the greater- and smaller-diameter portions to position an opening end of the first portion 862 of the case 860.

The body 810 is formed at an outer surface thereof with a connector ring, as illustrated in FIG. 13.

The coil spring 40 is comprised of a compressed coil spring, for instance, similarly to the first embodiment.

The clasp 800 in accordance with the eighth embodiment is assembled as follows.

First, the front 835 of the cylinder 830 is positioned in the third portion 864 of the case 860 through the opening 865 of the case 860.

Then, the pin 850 is inserted into the through-hole 868 formed at the third portion 864 of the case 860 and the through-hole 837 formed at the front 835.

The coil spring 40 is inserted into the spring holder 840 such that the coil spring 40 makes contact at one end thereof with the spring-force receiver 838 of the cylinder 830.

With the second portions 52*b* of the pin 850 being kept contracted, the case 860 and the cylinder 830 connected to each other through the pin 850 are assembled to the body 810.

Specifically, an opening end of the first portion 862 makes abutment with the step 813A, the second portion 863 is arranged between a pair of the walls 814, and the third portion 864 is arranged between a pair of the walls 812, as illustrated in FIG. 16.

The coil spring 40 is compressed between an inner surface of the body 810 and the spring-force receiver 838 by compressing the cylinder 830 at an end thereof opposite to an end making contact with the spring-force receiver 838, into an inner surface of the body 810.

As a result of disposing the case 860 in the body 810 in the above-mentioned manner, when the contracted second portions 52*b* reach the holes 812A formed through the walls 812, the second portions 52*b* extend into the holes 812A. FIG. 13 illustrates this condition.

Thus, the pin 850 not only fixes the third portion 864 to the body 810, but also prevents the cylinder 830 and the coil spring 40 from dropping out of the body 810. In this condition, the cylinder 830 can move downwardly in FIGS. 13 and 14 relative to the body 810 and the case 860 against a spring force provided by the coil spring 40.

As illustrated in FIGS. 13 and 14, a center of the pin 850 is located on an extension of an axis of the coil spring 40 in the eighth embodiment. Hence, it is possible to minimize a width of the body 810 (that is, a horizontal length of the body 810 in FIG. 14) in comparison with the same in a later mentioned ninth embodiment.

Then, the pin 50 is inserted into the through-hole 883 formed at the main body 882 of the connector 880.

Then, a core wire (not illustrated) for the necklace 80 is introduced into the main body 882 through the hole 884 of the connector 880, and the core wire is connected at an end thereof to the pin 50 such that the core wire is not loosened. Thus, a ball of the necklace 80 located at an end lies on the ball receiver 888 of the connector 880.

Then, with the second portions 52*b* of the pin 50 being contracted, the main body 882 and the pin 50 are inserted into the second portion 863 of the case 860 through the hole 815 of the body 810. When the pin 50 is inserted into the second portion 863, the pin 50 is guided by the cut-outs 867, and the second portions 52*b* slide at distal ends thereof on inner surfaces of the walls 814.

When the contracted second portions 52*b* reach the holes 814A, the second portions 52*b* extend into the holes 814A. FIG. 13 illustrates this condition.

Thus, the connector 880 is fixed to the body 810 through the pin 50, and the necklace 80 is connected at one end thereof to the body 810 through the connector 880.

The necklace 80 is connected to the pin 870 by introducing an end of the core wire into the pin 870 through the hollow space 871,;and winding the core wire around the beams 872.

Though not illustrated, a charm is connected to the connector ring 816 of the body 810.

An operation of the clasp 800 is explained hereinbelow.

The stopper 836 is engaged to the pin 870 as follows.

First, the pin 870 is inserted at the distal end 22 thereof into the hole 813 of the body 810.

After the distal end 22 of the pin 870 have reached the stopper 836, the pin 870 is further inserted deeply into the hole 813. As a result, the stopper 836 is gradually compressed by the distal end 22 of the pin 870, and moves downwardly in FIG. 13 against a force provided by the coil spring 40. Specifically, the cylinder 830 at entirety thereof moves downwardly in FIG. 13, and the front 835 of the cylinder 830 moves downwardly in the third portion 864 in FIG. 13. Though the pin 850 does not actually move, since the cylinder 830 moves downwardly in FIG. 13, the pin 850 relatively moves upwardly in the through-hole 837 relative to the cylinder 830.

Thereafter, the pin 870 is further inserted deeply into the body 810. When the groove 21 reaches the stopper 836, the stopper 836 is energized by the coil spring 40 to move upwardly in FIG. 13. Thus, the stopper 836 enters the groove 21. That is, the stopper 836 is engaged to the groove 21. When the stopper 836 moves, the cylinder 830 also moves upwardly in FIG. 13. The front 835 moves upwardly in FIG. 13 in the third portion 864 of the case 860. Though the pin 850 does not move, since the cylinder 830 moves upwardly in FIG. 13, the pin 850 relatively moves downwardly in the through-hole 837 relative to the cylinder 830.

Thus, the stopper 836 is engaged to the pin 870 as illustrated in FIG. 13, ensuring that the pin 870 is prevented from releasing from the body 810.

Next, an operation for ceasing the engagement of the stopper 836 with the pin 870 is explained hereinbelow.

When the pin 870 is to be released from the stopper 836, the releaser 832 illustrated in FIG. 14 is pushed downwardly in FIG. 14 with a finger of a user, that is, the releaser 832 is slid downwardly along the body 810.

That is, the pin 870 is released from the stopper 836 by sliding the cylinder 830 including the releaser 832 downwardly in FIG. 14 against a force provided by the coil spring 40. Thereafter, the pin 870 can be pulled out of the body 810.

In accordance with the clasp 800, it is possible to release the pin 870 from the stopper 836 by carrying out a novel and unique operation, that is, sliding the releaser 832.

An operation for exchanging a part into a new one for some reason is explained hereinbelow.

For instance, when any part is broken, or any part is exchanged to a differently ornamental part, part-exchange operation is carried out.

A part is exchanged to another part after the pin 870 is pulled out of the body. 810. For instance, a pin 890 illustrated in FIG. 20 is used.

As illustrated in FIG. 20, the pin 890 used for exchanging a part into a new one is comprised of a rod 891, and a bending portion 892 formed at a distal end of the rod 891.

As illustrated in FIG. 16, the clasp 800 is formed at a rear thereof with a plurality of openings 800A between the cylinder 830 and the body 810.

The pin 890 is inserted into the body 810 through one of the openings 800A.

For instance, the pin 890 is inserted into the body 810 trough the opening 800A leading to the second portions 52*b* of the pin 50, and the second portions 52*b* of the pin 50 are contracted by means of the bending portion 892 of the pin 890. With the second portions 52*b* of the pin 50 being kept contracted, the connector 880 is released from the body 810.

Then, the pin 890 is inserted into the body 810 trough the opening 800A leading to the second portions 52*b* of the pin 850, and the second portions 52*b* of the pin 850 are contracted by means of the bending portion 892 of the pin 800. With the second portions 52*b* of the pin 850 being kept contracted, the case 860 and the cylinder 830 are released from the body 810.

Thus, any one or more of the pin 50, the pin 850, the coil spring 40, the cylinder 830, the connector 880, the case 860 and the body 810 can be exchanged to a new one.

As mentioned above, the connector 880 and the pin 870 are connected to each other through the necklace 880. In other words, the necklace 80, the connector 880 and the pin 870 are integral with one another.

Hence, as a preferable example for exchanging a part into a new one, the body 810, the cylinder 830, the pin 850 and the case 860 may be all exchanged into new ones.

In order to exchange a part of the necklace 80 integral with the clasp 800, a user had to bring his/her necklace not to a jewelry shop, but to a jewelry manufacturer. Since the connector 880 is detachable from the body 810 in the clasp 800, a jewelry shop can readily exchange a part of the clasp 800 into a new one.

When the body 810, the cylinder 830, the pin 850 and the case 860 are necessary to be exchanged into new ones, it is necessary to release the pin 850 only, and it is not necessary to release the pin 850.

The clasp 800 in accordance with the eighth embodiment makes it possible to release the pin 870 from the stopper 836 merely by sliding the releaser 832, ensuring that a user would not have a pain in his/her finger, even if the releaser 832 is small in size.

Furthermore, since the in 870 can be released from the stopper 836 by carrying out a novel and unique operation, that is, sliding the releaser 832, the clasp 800 can draw attention of users with respect to a function.

In addition, since the cylinder 830, the coil spring 40, the case 860, and the connector 880 can be assembled to the body 810 by means of the two pins 50 and 850, the clasp 800 can be comprised of a small number of parts, the clasp 800 can be readily assembled, and a part of the clasp 800 can be exchanged to a new one.

Furthermore, since the pins 50 and 850 are hidden in the body 810, the clasp 800 could have good appearance.

The openings 800A illustrated in FIG. 16 have a function identical with that of the hole 38 in the first embodiment. Hence, a sound generated when the stopper 836 is engaged to the pin 870 reaches a user through the openings 800A, ensuring a user to check whether the pin 870 is surely engaged to the body 810.

The parts constituting the clasp 800 can be assembled to one another after plated, painted or ornamented. Hence, it would be possible to differentiate color of the parts from one another.

The body 810 may be in any form. For instance, the body 810 may be not only circular, but also rectangular parallelepiped, spherical or elliptic.

The connector 880 and the pin 870 in the eighth embodiment may be applied to later mentioned ninth and tenth embodiments.

Ninth Embodiment

Figure 21:
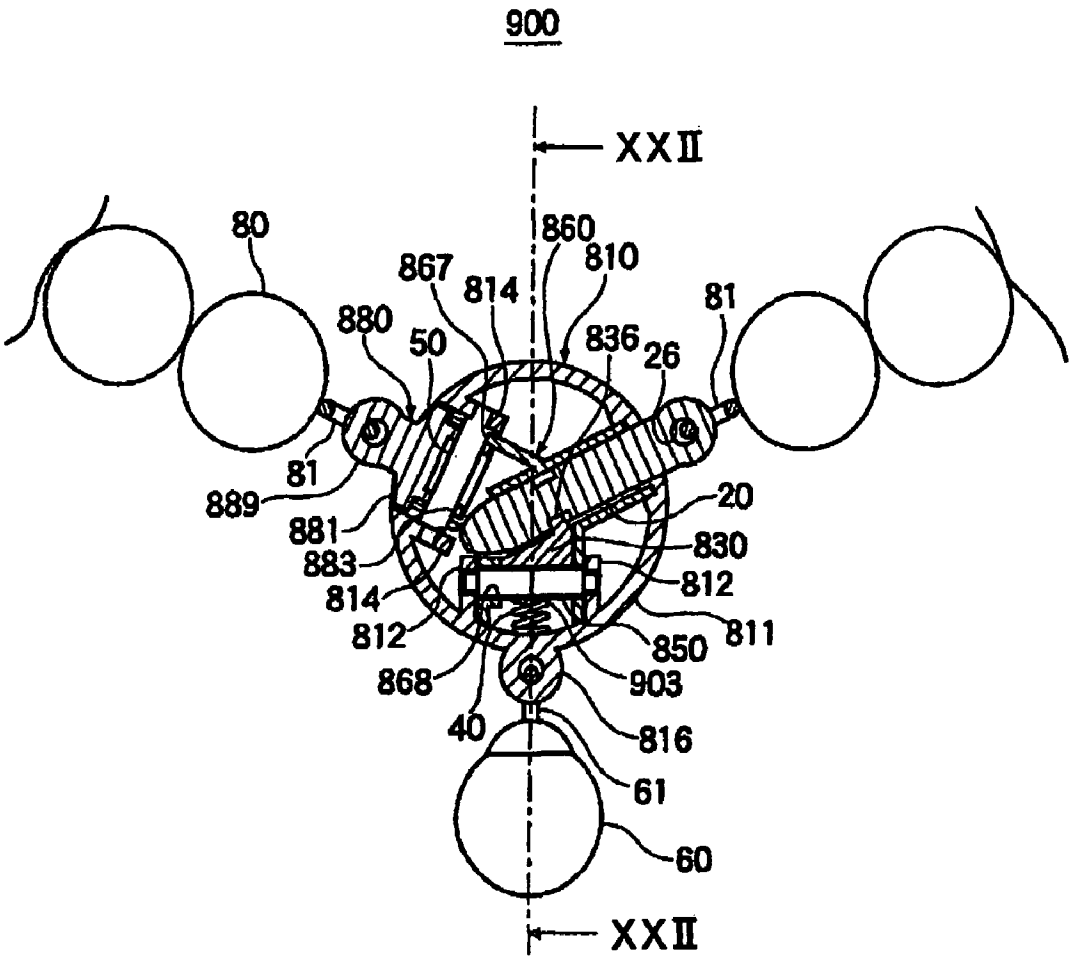
FIG. 21 is a cross-sectional view of a clasp in accordance with the ninth embodiment of the present invention.
Figure 22:
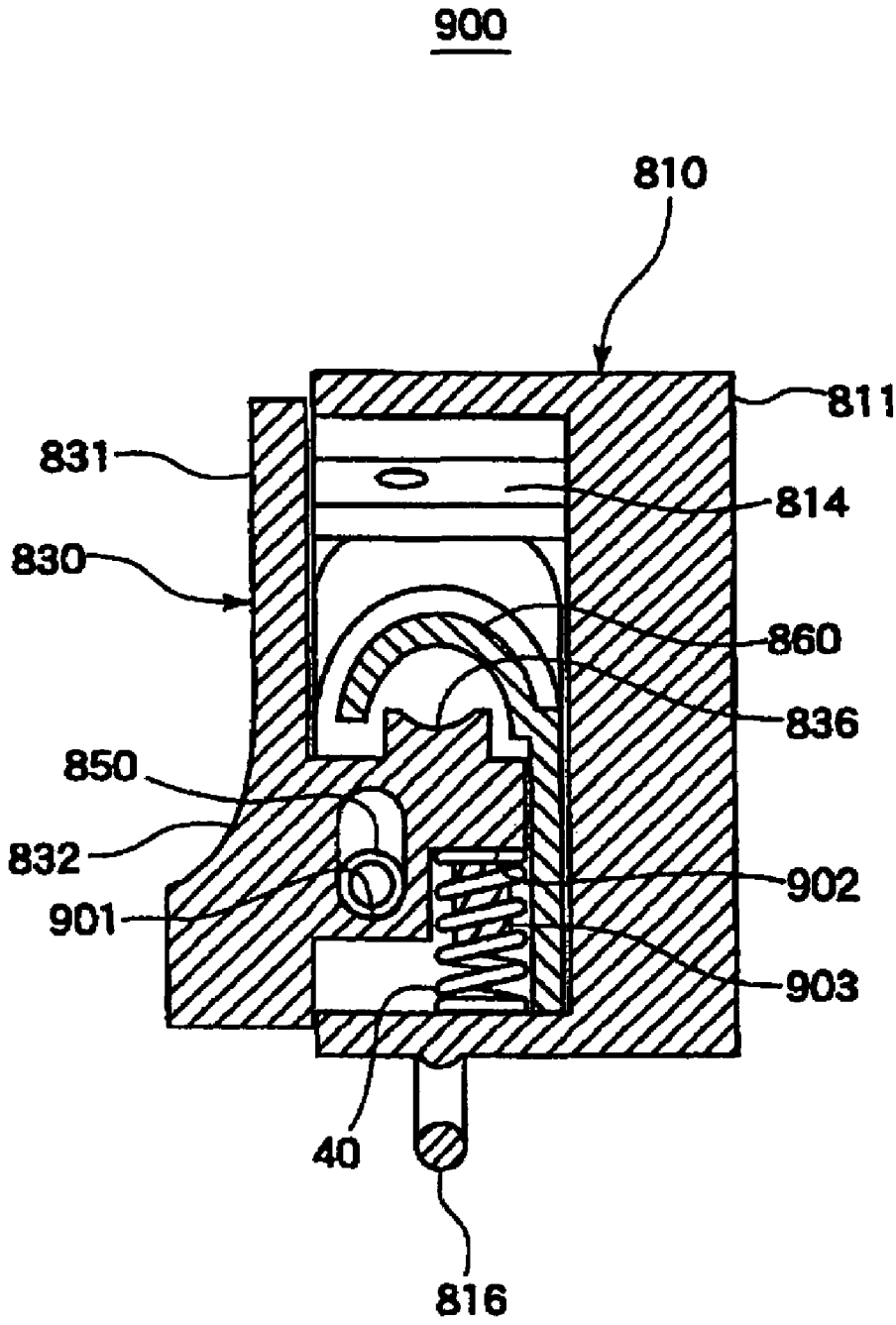
FIG. 22 is a cross-sectional view taken along the line XXII-XXII in FIG. 21.

FIG. 21 is a cross-sectional view of a clasp 900 in accordance with the ninth embodiment of the present invention, and FIG. 22 is a cross-sectional view taken along the line XXII-XXII in FIG. 21.

Hereinbelow is explained the clasp 900 with reference to FIGS. 21 and 22.

The clasp 900 is structurally different from the clasp 800 in accordance with the eighth embodiment only in what is explained later. Hence, parts or elements that correspond to clasp 800 have been provided with the same reference numerals, and are not explained.

The pin 850 and the coil spring 40 in the clasp 900 are differently arranged from those in the clasp 800.

Whereas a center of the pin 850 is disposed on an extension of an axis of the coil spring 40 in the clasp 800 in accordance with the eighth embodiment, a center of the pin 850 is not disposed on an extension of an axis of the coil spring 40 in the clasp 900 in accordance with the ninth embodiment, as illustrated in FIG. 22. In addition, the pin 850 is disposed in horizontal alignment with the coil spring 40.

Specifically, the coil spring 40 is disposed before the pin 850, that is, the coil spring 40 is disposed at the right side in FIG. 22 relative to the pin 850.

Hence, the cylinder 830 in the ninth embodiment is structurally different from the cylinder 830 in the eighth embodiment.

Specifically, the cylinder 830 in the ninth embodiment is formed with a through-hole 901 in place of the through-hole 837 in the eighth embodiment. The through-hole 901 is disposed rear relative to the through-hole 837, that is, disposed more closer to the releaser 832 than the coil spring 40.

The cylinder 830 in the ninth embodiment is formed with a pillar 903 in place of the recess 840 in the eighth embodiment. As illustrated in FIGS. 21 and 22, the coil spring 40 is partially arranged around the pillar 903.

The cylinder 830 in the ninth embodiment is formed with a spring-force receiver 902 in place of the spring-force receiver 838 in the eighth embodiment. The spring-force receiver 902 is disposed at a proximal end of the pillar 903.

The connector 880 in the ninth embodiment is slightly different in structure from the same in the eighth embodiment.

Specifically, the connector 880 in the ninth embodiment does not include the ball receiver 888 and the through-hole 884, but includes a connector ring 889 to which the necklace 80 is connected at an end.

The clasp 900 includes the pin 20 having the same structure as the pin 20 in the first embodiment.

The pin 20 and the connector 880 are not limited in structure to those in the ninth embodiment, but may have any structure.

The clasp 900 in accordance with the ninth embodiment provides the same advantages as those provided by the eighth embodiment. Furthermore, since an axis of the coil spring 40 and an axis of the pin 850 are not disposed on a common line, and the coil spring 40 and the pin 850 are in horizontal alignment with each other, it would be possible to form the body 810 smaller vertically in FIG. 22 than the body 810 in the eighth embodiment.

The connector 880 in the ninth embodiment may be applied to the eighth embodiment and a later mentioned tenth embodiment.

Figure 23:
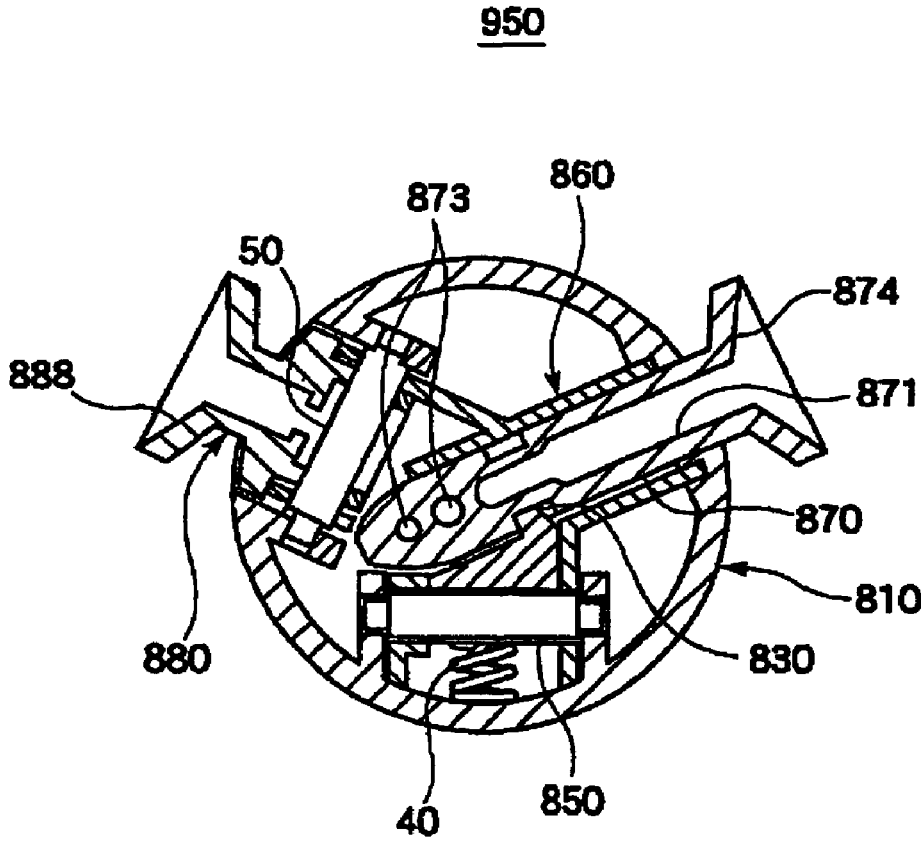
FIG. 23 is a cross-sectional view of a clasp in accordance with a variance of the ninth embodiment.

FIG. 23 is a cross-sectional view of a clasp 950 in accordance with a variance of the ninth embodiment.

The clasp 950 is structurally different from the clasp 900 in accordance with the ninth embodiment only in the pin 870 and the connector 880.

With reference to FIG. 23, the pin 870 has almost the same structure as the pin 870 in the eighth embodiment. Specifically, the pin 870 has a hollow internal space 871, and holes 873 to which a core wire is fixed.

The pin 870 is formed at an opening end of the hollow internal space 871 with a ball receiver 874 on which one of balls constituting the necklace 80 lies.

The variance illustrated in FIG. 23 provides the same advantages as those provided by the ninth embodiment.

The connector 880 and the pin 870 illustrated in FIG. 23 may be applied to the above-mentioned eighth embodiment and a later mentioned tenth embodiment. The pin 870 illustrated in FIG. 23 may be applied to the above-mentioned first to ninth embodiments.

Tenth Embodiment

Figure 24:
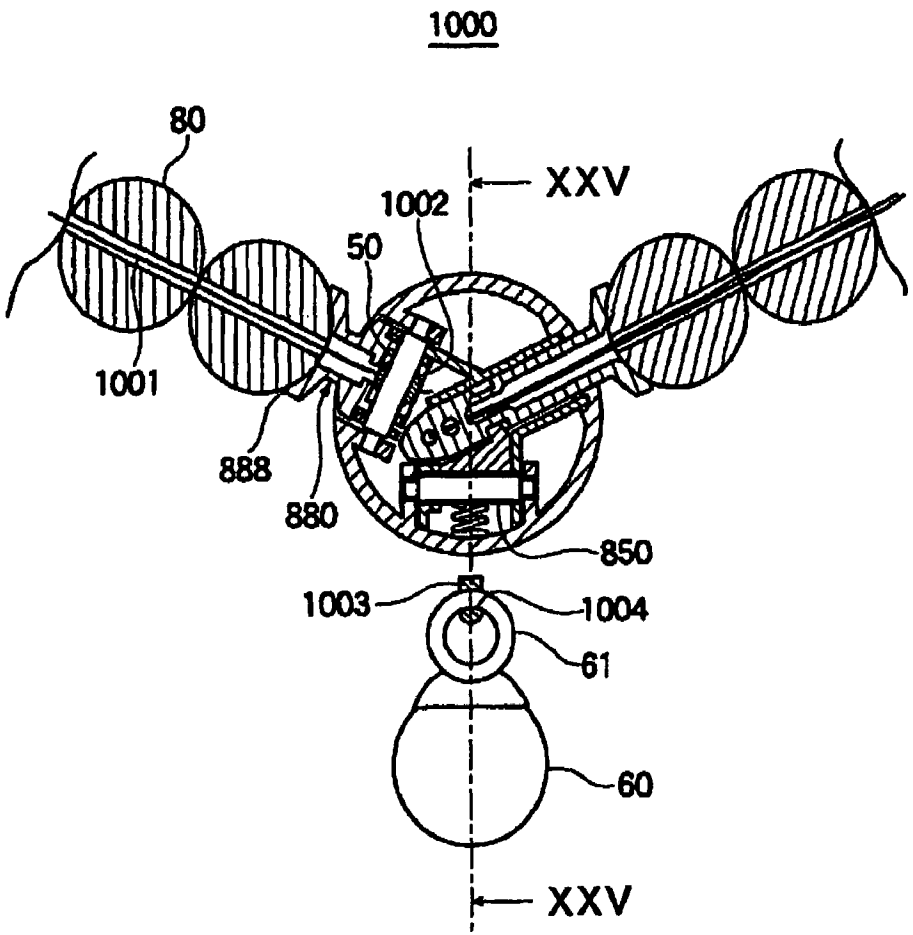
FIG. 24 is a cross-sectional view of a clasp in accordance with the tenth embodiment of the present invention.
Figure 25:
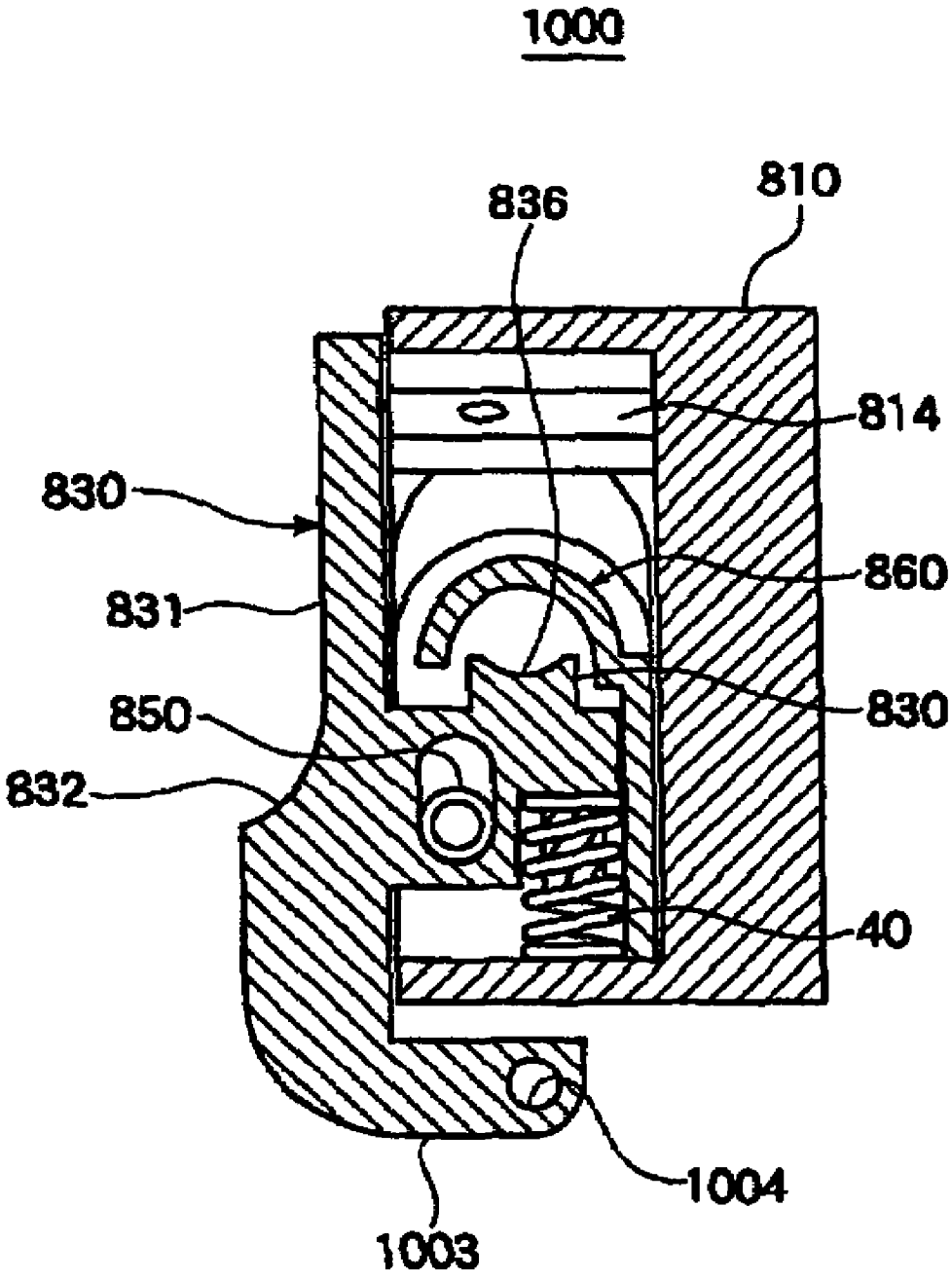
FIG. 25 is a cross-sectional view taken along the line XXV-XXV in FIG. 24.

FIG. 24 is a cross-sectional view of a clasp 1000 in accordance with the tenth embodiment of the present invention, and FIG. 25 is a cross-sectional view taken along the line XXV-XXV in FIG. 24.

Hereinbelow is explained the clasp 1000 with reference to FIGS. 24 and 25.

Whereas the pin 870 is released from the stopper 836 by sliding the releaser 832 in the above-mentioned eighth and ninth embodiments, the pin 870 is released from the stopper 836 by sliding and pulling the releaser 832 in the tenth embodiment.

The clasp 1000 is structurally different from the clasp 950 in accordance with a variance of the ninth embodiment only in what is explained later. Hence, parts or elements that correspond to clasp 950 have been provided with the same reference numerals, and are not explained.

As illustrated in FIG. 25, the cylinder 830 is designed to have a L-shaped portion 1003 comprised of a first portion extending downwardly from the releaser 832, and a second portion extending forwardly (to the right in FIG. 25) from a distal end of the first portion. The L-shaped portion 1003 is formed with at a distal end thereof with a hole 1004 to which a charm 60 is connected through a connector ring 61, as illustrated in FIG. 24.

Hence, the pin 870 can be released from the stopper 836 by downwardly pulling the charm 60.

As illustrated in FIG. 24, a core wire 1001 passes through balls (such as pearls) constituting the necklace 80, and a distal end of the core wire 1001 is connected to the pin 50 in the connector 880 by means of a stopper 1002. This structure is applied to the above-mentioned eight and ninth embodiments illustrated in FIGS. 13 and 23, respectively.

The clasp 1000 in accordance with the tenth embodiment provides the same advantages as those provided by the ninth embodiment. Furthermore, since the L-shaped portion 1003 and the charm 60 act as a releaser, the clasp 1000 provides another advantage that the pin 870 can be released from the stopper 836 by downwardly pulling the charm 60.

Furthermore, the clasp 1000 could have variety in design by appropriately selecting a charm or ornamental connected to the hole 1004.

The L-shaped portion 1003 for pulling the releaser 832 may be applied to the clasp 800 in accordance with the eighth embodiment illustrated in FIG. 14.

Figure 26:
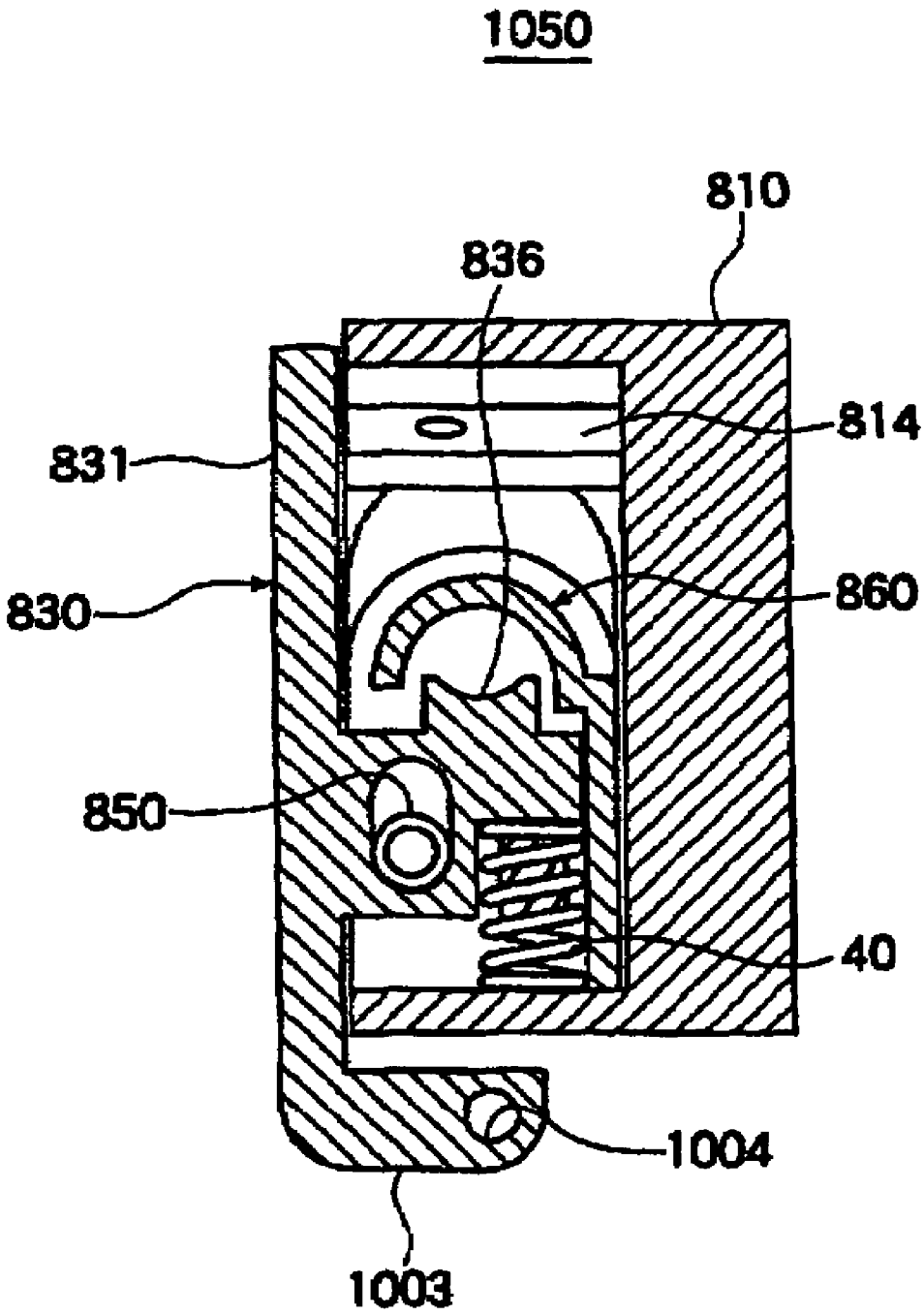
FIG. 26 is a cross-sectional view of a clasp in accordance with a variance of the tenth embodiment.
Figure 27:
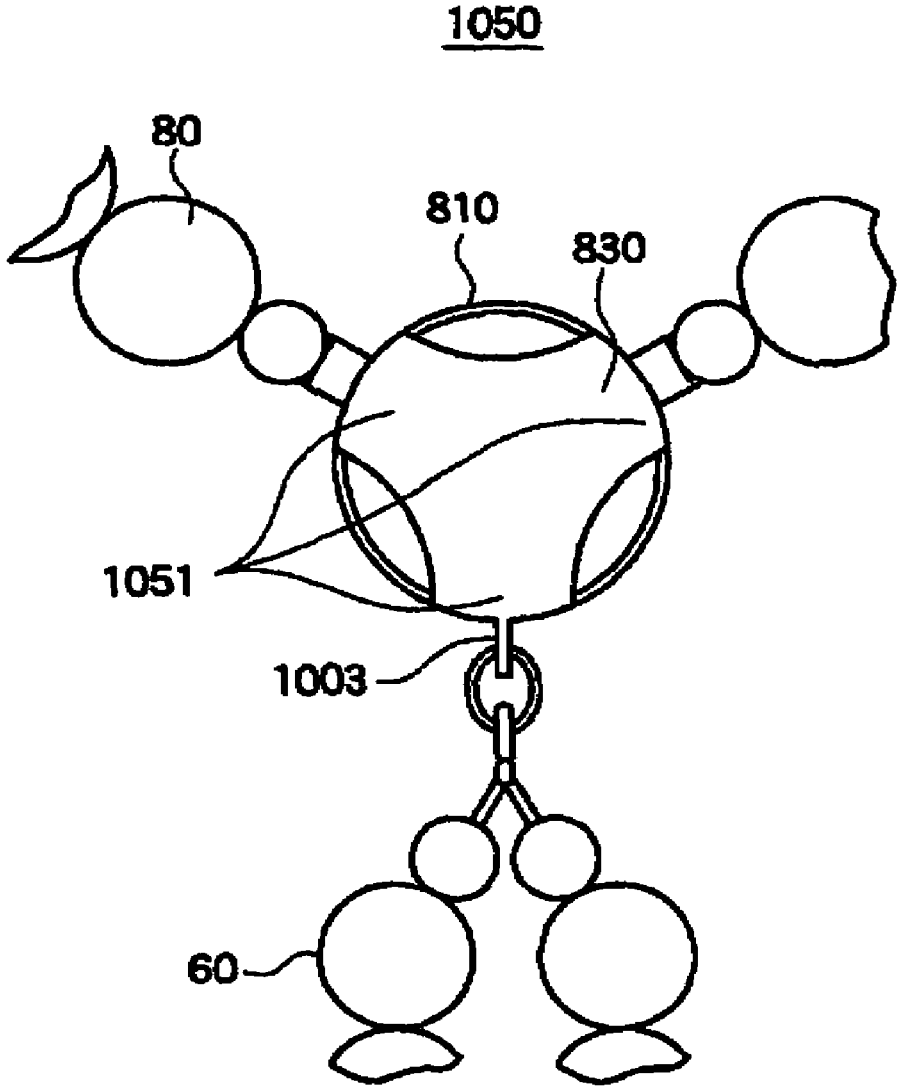
FIG. 27 is a rear view of a clasp in accordance with a variance of the tenth embodiment.

FIG. 26 is a cross-sectional view of a clasp 1050 in accordance with a variance of the tenth embodiment, and FIG. 27 is a rear view of the clasp 1050.

Whereas the clasp 1000 in accordance with the above-mentioned tenth embodiment includes the releaser 832, the clasp 1050 is designed not to include the releaser 832. Specifically the main body 831 of the cylinder 830 is flat at a rear thereof, and does not have a slope acting as the releaser 832.

Accordingly, the pin 870 is released from the stopper 836 by pulling the charm 60 (see FIG. 27) downwardly in the clasp 1050.

As illustrated in FIG. 27 the main body 831 of the cylinder 830 is designed to have a cover 1051 completely covering the first to third portions 862 to 864 of the case 860, ensuring good appearance of a rear of the clasp 1050. For instance, distal ends of the first to third portions 862 to 864 of the case 860 are exposed at a rear of the clasp 800 in accordance with the eighth embodiment, as illustrated in FIG. 16. The clasp 1050 provides better appearance of a rear than the clasp 800.

The main body 831 having the cover 1051 may be applied to the above-mentioned eighth to tenth embodiments.

The connector 880 and the case 860 having been explained in the eighth to tenth embodiments may be applied to the above-mentioned first to seventh embodiments.

The pin 20 having a plurality of the grooves 21 having been explained in the second embodiment may be applied to the other embodiments.

In the above-mentioned embodiments, the pin 50 illustrated in FIG. 7 may be used in place of the pin 50 or 850 illustrated in FIG. 3.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Applications Nos. 2004-053839 and 2005-016023 filed on Feb. 27, 2004 and Jan. 24, 2005, respectively including specification, claims, drawings and summary is incorporated herein by reference in its entirety.

What is claimed is:

1. A clasp for jewelry, comprising:

a body;

a pin insertable into said body;

a stopper engaging to said pin having been inserted into said body to keep said pin engaged to said body;

a releaser releasing said pin from said body;

a cylinder to which said stopper and said releaser are integrally formed, said cylinder being movable relative to said body; and a second stopper for preventing said cylinder from releasing from said body, wherein when pulled, said releaser releases said pin from said body, and wherein said second stopper passes through said cylinder, with said cylinder being inserted into said body, in a direction intersecting with a direction in which said cylinder is inserted into said body, and said second stopper is supported at its opposite ends by said body to prevent said second stopper and said cylinder from releasing from said body.

2. The clasp as set forth in claim 1, wherein said pin is formed with a groove through which said stopper is engaged to said pin.

3. The clasp as set forth in claim 1, wherein said pin is formed with a plurality of grooves through each of which said stopper is engaged to said pin, said grooves being arranged longitudinally of said pin.

4. The clasp as set forth in claim 1, wherein said second stopper is disposed in said body.

5. The clasp as set forth in claim 1, wherein said second stopper includes a spring therein, and at least one end of said second stopper is slidable against said spring, and wherein said second stopper and said cylinder can be released from said body by sliding said one end of said second stopper.

6. The clasp as set forth in claim 1, further comprising a coil spring energizing said cylinder in a direction in which said stopper engages to said pin, said coil spring being arranged around said cylinder.

7. The clasp as set forth in claim 6, wherein said coil spring receives reaction force from an inner surface of said body to thereby energize said cylinder.

8. The clasp as set forth in claim 6, wherein said cylinder and said coil spring are prevented from releasing from said body by said coil spring.

9. The clasp as set forth in claim 1, wherein said cylinder has an end disposed oppositely to said releaser, said end cooperating with said body to define an outer surface of said clasp.

10. The clasp as set forth in claim 1, wherein at least one of said cylinder and said body is formed with a hole through which a sound generated when said stopper is engaged to said pin is emitted out of said clasp.

11. The clasp as set forth in claim 1, further comprising a connector integrally formed with at least one of said pin, said body and said releaser, and wherein a charm is connected to said at least one of said pin, said body and said releaser through said connector.

12. The clasp as set forth in claim 1, wherein said releaser comprises a hole formed at a bottom portion of said cylinder.

13. The clasp as set forth in claim 1, further comprising a charm engaging said releaser.

14. The clasp as set forth in claim 13, wherein said releaser is pulled by pulling said charm.

15. A clasp for jewelry, comprising:

a body;

a pin insertable into said body;

a stopper engaging to said pin having been inserted into said body to keep said pin engaged to said body;

a releaser releasing said pin from said body;

a cylinder to which said stopper and said releaser are integrally formed, said cylinder being movable relative to said body; and a second stopper for preventing said cylinder from releasing from said body, wherein when pulled, said releaser releases said pin from said body, and wherein said second stopper is comprised of a pin.

* * * * *